US009640131B2

(12) United States Patent
Croxford

(10) Patent No.: US 9,640,131 B2
(45) Date of Patent: May 2, 2017

(54) METHOD AND APPARATUS FOR OVERDRIVING BASED ON REGIONS OF A FRAME

(71) Applicant: ARM LIMITED, Cambridge (GB)

(72) Inventor: Daren Croxford, Cambridge (GB)

(73) Assignee: ARM Limited, Cambridge (GB)

( * ) Notice: Subject to any disclaimer, the term of this patent is extended or adjusted under 35 U.S.C. 154(b) by 66 days.

(21) Appl. No.: 14/604,872

(22) Filed: Jan. 26, 2015

(65) Prior Publication Data

US 2015/0228248 A1 Aug. 13, 2015

(30) Foreign Application Priority Data

Feb. 7, 2014 (GB) ..... 1402168.7

(51) Int. Cl.
*G09G 3/36* (2006.01)
*G09G 3/20* (2006.01)
(Continued)

(52) U.S. Cl.
CPC ..... *G09G 3/3696* (2013.01); *G09G 3/2003* (2013.01); *G09G 3/2022* (2013.01); *G09G 5/363* (2013.01); *G09G 5/395* (2013.01); *G09G 2310/063* (2013.01); *G09G 2320/0252* (2013.01); *G09G 2320/0285* (2013.01)

(58) Field of Classification Search
CPC .. G09G 3/3696; G09G 3/2003; G09G 3/2022; G09G 5/363; G09G 5/395; G09G 2310/063; G09G 2320/0285; G09G 2320/0252
See application file for complete search history.

(56) References Cited

U.S. PATENT DOCUMENTS 5,181,131 A 1/1993 Yamazaki et al.
5,241,656 A 8/1993 Loucks et al.
(Continued)

FOREIGN PATENT DOCUMENTS

CN 1834890 9/2006
CN 101116341 1/2008
(Continued)

OTHER PUBLICATIONS

Final Office mailed Jul. 29, 2015 in co-pending U.S. Appl. No. 13/898,510 28 pages.
(Continued)

*Primary Examiner* — Liliana Cerullo
(74) *Attorney, Agent, or Firm* — Nixon & Vanderhye P.C.

(57) ABSTRACT

An overdrive engine generates output frames to be used to drive a display from input frames to be displayed. Each output frame is generated on a region by region basis from the corresponding regions of the input frames. If it is determined that an input frame region has changed significantly since the previous version(s) of the input frame, an overdriven version of the input frame region is generated for use as the corresponding region in the output frame. On the other hand, if it is determined that the input frame region has not changed since the previous version of the input frame, then the new input frame region is used without performing any form of overdrive process on it for the corresponding region in the output frame.

26 Claims, 16 Drawing Sheets

(51) Int. Cl.
*G09G 5/36* (2006.01)
*G09G 5/395* (2006.01)

(56) References Cited

U.S. PATENT DOCUMENTS

| | | | |
|---|---|---|---|
| 5,686,934 | A | 11/1997 | Nonoshita et al. |
| 6,069,611 | A | 5/2000 | Flynn et al. |
| 6,075,523 | A | 6/2000 | Simmers |
| 6,094,203 | A | 7/2000 | Desormeaux |
| 6,101,222 | A | 8/2000 | Dorricott |
| 6,304,606 | B1 | 10/2001 | Murashita et al. |
| 6,825,847 | B1 | 11/2004 | Molnar et al. |
| 7,190,284 | B1 | 3/2007 | Dye et al. |
| 7,671,873 | B1 | 3/2010 | Pierini et al. |
| 8,254,685 | B2 | 8/2012 | Greene et al. |
| 8,749,711 | B2 | 6/2014 | Um |
| 8,988,443 | B2 | 3/2015 | Croxford et al. |
| 9,182,934 | B2 | 11/2015 | Croxford et al. |
| 9,195,426 | B2 | 11/2015 | Croxford et al. |
| 9,349,156 | B2 | 5/2016 | Croxford et al. |
| 9,406,155 | B2 | 8/2016 | Oterhals et al. |
| 2002/0036616 | A1 | 3/2002 | Inoue |
| 2003/0080971 | A1 | 5/2003 | Hochmuth et al. |
| 2004/0141613 | A1 | 7/2004 | Hayashi |
| 2005/0168471 | A1 | 8/2005 | Paquette |
| 2005/0285867 | A1 | 12/2005 | Brunner et al. |
| 2006/0050976 | A1 | 3/2006 | Molloy |
| 2006/0152515 | A1 | 7/2006 | Lee et al. |
| 2006/0188236 | A1 | 8/2006 | Kitagawa |
| 2006/0203283 | A1 | 9/2006 | Fujimoto |
| 2007/0005890 | A1 | 1/2007 | Gabel et al. |
| 2007/0083815 | A1 | 4/2007 | Delorme et al. |
| 2007/0146380 | A1 | 6/2007 | Nystad et al. |
| 2007/0188506 | A1 | 8/2007 | Hollevoet et al. |
| 2007/0257925 | A1 | 11/2007 | Brunner et al. |
| 2007/0261096 | A1 | 11/2007 | Lin et al. |
| 2007/0273787 | A1 | 11/2007 | Ogino et al. |
| 2007/0279574 | A1* | 12/2007 | Minamizaki ..... G09G 3/3648 349/192 |
| 2008/0002894 | A1 | 1/2008 | Hayon et al. |
| 2008/0059581 | A1 | 3/2008 | Pepperell |
| 2008/0143695 | A1 | 6/2008 | Juenemann et al. |
| 2009/0033670 | A1 | 2/2009 | Hochmuth et al. |
| 2009/0202176 | A1 | 8/2009 | Hwang et al. |
| 2010/0058229 | A1 | 3/2010 | Mercer |
| 2010/0332981 | A1 | 12/2010 | Lipton et al. |
| 2011/0074765 | A1 | 3/2011 | Oterhals et al. |
| 2011/0074800 | A1 | 3/2011 | Stevens et al. |
| 2011/0080419 | A1 | 4/2011 | Croxford et al. |
| 2011/0102446 | A1 | 5/2011 | Oterhals et al. |
| 2012/0092451 | A1 | 4/2012 | Nystad et al. |
| 2012/0176386 | A1 | 7/2012 | Hutchins |
| 2012/0206461 | A1 | 8/2012 | Wyatt et al. |
| 2012/0268480 | A1 | 10/2012 | Cooksey et al. |
| 2012/0293545 | A1 | 11/2012 | Engh-Halstvedt et al. |
| 2013/0067344 | A1 | 3/2013 | Ungureanu et al. |
| 2014/0152891 | A1* | 6/2014 | Gilbert ..... G06K 9/00744 348/441 |
| 2015/0187123 | A1 | 7/2015 | Hwang et al. |
| 2016/0021384 | A1 | 1/2016 | Croxford et al. |

FOREIGN PATENT DOCUMENTS

| | | | |
|---|---|---|---|
| EP | 1 035 536 | A2 | 9/2000 |
| EP | 1 484 737 | A1 | 12/2004 |
| JP | 63-298485 | | 12/1988 |
| JP | 05266177 | A | 3/1992 |
| JP | 5-227476 | | 9/1993 |
| JP | 5-266177 | | 10/1993 |
| JP | 11-328441 | | 11/1999 |
| JP | 11-355536 | | 12/1999 |
| JP | 2004-510270 | | 4/2004 |
| JP | 2005-195899 | | 7/2005 |
| JP | 2006-268839 | | 10/2006 |
| JP | 2007-81760 | | 3/2007 |
| JP | 2007-531355 | | 11/2007 |
| WO | WO 02/27661 | A2 | 4/2002 |
| WO | WO 2005/055582 | A2 | 6/2005 |
| WO | WO 2008/026070 | | 3/2008 |
| WO | WO 2014/088707 | | 6/2014 |

OTHER PUBLICATIONS

Final Office mailed Aug. 7, 2015 in co-pending U.S. Appl. No. 12/923,518 27 pages.

Bergsagel, Jonathan, et al., "Super high resolution displays empowered by the OMAP4470 mobile processor: WUXGA resolution tablets now becoming a reality for the Android ecosystem", Texas Instruments, Dallas, Texas, 2012, pp. 1-16.

Khan, Moinul H., et al., "Bandwidth-efficient Display Controller for Low Power Devices in Presence of Occlusion", Consumer Electronics, ICCE 2007, Digest of Technical Papers, International Conference on Jan. 10-14, 2007 (2 pages).

Park, Woo-Chan, et al., "Order Independent Transparency for Image Composition Parallel Rendering Machines", P.-C. Yew and J. Xue (Eds.): A CSA 2004, LNCS 3189, 2004, pp. 449-460.

Heade, T., et al., "HDR Image Composition and Tone Mapping on the Cell Processor", MSc Interactive Entertainment Technology, Trinity College Dublin, Graphic Vision and Visualisation GV2 group, Dec. 11, 2009, pp. 59-66.

"Quick look at the Texas Instruments TI OMAP 4470 CPU, Kindle Fire HD CPU", Arctablet News, 2014 Arctablet Blog, pp. 1-7.

"Composition Processing Cores (CPC)", http://www.vivantecorp.com/index.php/en/technology/compostion.html, (2 pages) retrieved Aug. 20, 2014.

U.S. Appl. No. 12/588,459, of Oterhals et al., filed Oct. 15, 2009.

U.S. Appl. No. 12/588,461, of Stevens et al., filed Oct. 15, 2009.

U.S. Appl. No. 12/923,518, of Oterhals et al., filed Sep. 24, 2010.

U.S. Appl. No. 13/435,733, of Cooksey et al., filed Mar. 30, 2012.

Combined Search and Examination Report, Jul. 27, 2012 in United Kingdom application No. GB1205846.7, 6 pages.

U.S. Appl. No. 14/032,481, filed Sep. 20, 2013; Inventor; Croxford et al.

XDamage Extension, http://www.freedesktop.org/wiki/Software/XDamage/?action=print, last edited May 18, 2013, 2 pages.

Creating a polygon shape from a 2d tile array, mhtml:// X:\Documents and Settings\jtothill.DEHNS.002\LocalSettings\Temporar . . . , last edited Oct. 5, 2009, 3 pages.

Android-eepc / base, http://gitorious.org/android-eepc/base/source/ . . . , 2007 ©, 9 pages.

"Qt source code", 2013 ©, 264 pages https://qt.gitarious.org/qt/qt/source/427e398a7b7f3345fb4dcbc275b3ea29f211851b:src/qui.kernel/qwidget.cpp.

EGL (OpenGL), http://en.wikipedia.org/wiki/EGL_(OpenGL), last edited Sep. 21, 2012, 2 pages.

U.S. Appl. No. 12/923,517, filed Sep. 24, 2010; Inventor: Croxford et al.

U.S. Appl. No. 13/898,510, filed May 21, 2013; Inventor: Croxford et al.

Office Action mailed Feb. 21, 2012 in U.S. Appl. No. 12/588,459, pp. 1-29.

Office Action mailed Feb. 21, 2012 in U.S. Appl. No. 12/588,461, pp. 1-29.

Office Action mailed Aug. 29, 2012 in U.S. Appl. No. 12/588,459, pp. 1-29.

Office Action mailed Jan. 22, 2013 in U.S. Appl. No. 12/588,459, pp. 1-20.

Office Action mailed Jun. 20, 2013 in U.S. Appl. No. 12/588,459, pp. 1-26.

Office Action mailed Jul. 2, 2013 in U.S. Appl. No. 12/588,459, pp. 1-24.

Office Action mailed Feb. 17, 2012 in U.S. Appl. No. 12/588,461, pp. 1-20.

Office Action mailed Aug. 30, 2012 in U.S. Appl. No. 12/588,461, pp. 1-22.

Office Action mailed Jun. 5,2013 in U.S. Appl. No. 12/588,461, pp. 1-20.

(56) References Cited

OTHER PUBLICATIONS

Office Action mailed Dec. 3,2013 in U.S. Appl. No. 12/588,461, pp. 1-18.
Office Action mailed Nov. 8, 2013 in U.S. Appl. No. 12/923,518, pp. 1-18.
Office Action mailed Nov. 21, 2013 in U.S. Appl. No. 12/923,517, pp. 1-21.
Shim et al., *A Compressed Frame Buffer to Reduce Display Power Consumption in Mobile Systems*, IEEE, Asia and South Pacific Design Automation Conference (ASP-DAC'04) pp. 1-6.
Shim, *Low-Power LCD Display Systems*, School of Computer Science and Engineering, Seoul National University, Korea, 2 pages.
Shim et al., A Backlight Power Management Framework for Battery-Operated Multimedia Systems, Submitted to IEEE Design and Test of Computers, Special Issue on Embedded Systems for Real-Time Multimedia, vol. 21, Issue 5, pp. 388-396, May-Jun. 2004.
Chamoli, Deduplication—A Quick Tutorial, Aug. 8, 2008, http://thetoptenme.wordpress.com/2008/08/08/duplication-a-quick-tutorial/ pp. 1-5.
Hollevoet et al., *A Power Optimized Display Memory Organization for Handheld User Terminals*, IEEE 2004, pp. 1-6.
Akeley et al., Real-Time Graphics Architecture, http://graphics.stanford.edu/courses/cs448a-01-fall, 2001, pp. 1-19.
United Kingdom Search Report in United Kingdom Application No. GB 0916924.4, Jan. 15, 2010, 3 pages.
UK Combined Search and Examination Report dated Jan. 26, 2011 in GB 1016162.8, 6 pages.
UK Combined Search and Examination Report dated Jan. 26, 2011 in GB 1016165.1, 6 pages.
Gatti et al., Lower Power Control Techniques for TFT LCD Displays, Oct. 8-11, 2002, Grenoble, France, pp. 218-224.
Choi et al., Low-Power Color TFT LCD Display for Hand-Held Embedded Systems, Aug. 12-14, 2002, Monterey, California, pp. 112-117.
Iyer et al., Energy-Adaptive Display System Designs for Future Mobile Environments, HP Laboratories Palto Alto, Apr. 23, 2003, 15 pages.
Carts-Powell, Cholesteric LCDs Show Images After Power is Turned Off; OptoIQ, Sep. 1, 1998, 5 pages.
Zhong et al., Energy Efficiency of Handheld Computer Interfaces Limits, Characterization and Practice, pp. 247-260.
Patel et al., Frame Buffer Energy Optimization by Pixel Prediction, Proceedings of the 2005 International Conference on Computer Design, Jun. 2005, 4 pages.
R. Patel et al., Parallel Lossless Data Compression on the GPU, 2012 IEEE, 10 pages, In Proceedings of Innovative Parallel Computing (InPar '12). May 13-14, 2012. San Jose, California.
Smalley, ATI's Radeon X800 Series Can Do Transparency AA Too, Sep. 29, 2005, 2 pages.
Esselbach, Adaptive Anti-Aliasing on ATI Radeon X800 Boards Investigated, Oct. 17, 2005, 4 pages.
Digital Visual Interface DVI, Revision 1.0, Digital Display Working Group, Apr. 2, 1999, pp. 1-76.
Ma, OLED Solution for Mobile Phone Subdisplay, Apr. 2003, 5 pages.
Z. Ma et al., Frame Buffer Compression for Low-Power Video Coding, 2011 18$^{th}$ IEEE International Conference on Image Processing, 4 pages, Date of conference: Sep. 11-14, 2011.
M. Weinberger et al., The LOCO-I Lossless Image Compression Algorithm: Principles and Standardization into JPEG-LS, pp. 1-34; Published in: Image Processing, IEEE Transactions on . . . (vol. 8, Issue 8), Aug. 2000.
T.L. Bao Yng et al., Low Complexity, Lossless Frame Memory Compression Using Modified Hadamard Transform and Adaptive Golomb-Rice Coding, IADIS International Conference Computer Graphics and Visualization 2008, Jul. 15, 2008, pp. 89-96.
A.J. Penrose, Extending Lossless Image Compression, Technical Report No. 526, Dec. 2001, pp. 1-149.
M. Ferretti et al., A Parallel Pipelined Implementation of LOCO-I for JPEG-LS, 4 pages; Date of conference: Aug. 23-26, 2004.
Jbarnes' braindump :: Intel display controllers; Jan. 26, 2011; http://virtuousgeek.org/blog/index.php/jbarnes/2011/01/26/intel_display_controllers; 5 pages, Jan. 26, 2011.
Quick Look at the Texas Instruments TI OMAP 4470 CPU, Kindle Fire HD CPU, http://www.arctablet.com/blog/featured/quick-look-texas-instruments-ti-omap-4470-cpu; posted Sep. 6, 2012 in Archos Gen10 CPU TI OMAP TI OMAP 4470; 12 pages; Sep. 6, 2012.
Office Action mailed Dec. 20, 2013 in U.S. Appl. No. 13/435,733, pp. 1-29.
U.S. Office Action issued in U.S. Appl. No. 12/923,518 dated Jul. 18, 2014.
U.S. Office Action issued in U.S. Appl. No. 12/588,461 dated Jul. 22, 2014.
Japanese Office Action issued in Japanese Patent Application No. 2010-213509 dated Jun. 23, 2014 (w/translation)—7 pages.
U.S. Appl. No. 14/255,395, filed Apr. 17, 2014, Croxford et al.
Chinese First Office Action dated Jun. 11,2014 in CN 201010294392.9 and English translation, 17 pages.
Chinese First Office Action dated Jul. 31, 2014 in CN 201010294382.5 and English translation, 54 pages.
English Translation of Japanese Official Action mailed Apr. 7, 2014 in Japanese Application No. 2010-213508; Japanese Office Action mailed Apr. 7, 2014 in Japanese Application No. 2010-213508.
Arctablet (http://www.arctablet.com/blog . . . ) 2010, 12 pages.
Final Rejection mailed Jul. 2, 2013 in co-pending U.S. Appl. No. 12/588,459.
Office Action mailed Dec. 20, 2013 in co-pending U.S. Appl. No. 13/435,733.
U.S. Office Action issued in U.S. Appl. No. 13/435,733 dated Jun. 17, 2014.
Final Rejection mailed Feb. 24, 2015 in co-pending U.S. Appl. No. 12/588,461.
Non-final Rejection mailed Dec. 26, 2014 in co-pending U.S. Appl. No. 12/923,518.
Vesa Digital Packet Video Link Standard, Video Electronics Standards Association, Version 1, Apr. 18, 2004, 86 pages.
Office Action mailed Mar. 24, 2015 in U.S. Appl. No. 13/898,510, 35 pages.
Office Action mailed Apr. 2, 2015 in U.S. Appl. No. 13/435,733, 39 pages.
Final Office Action mailed Jan. 4, 2016 in co-pending U.S. Appl. No. 13/435,733 37 pages.
Notice of Allowance mailed Jul. 7, 2015 in co-pending U.S. Appl. No. 14/032,481 24 pages.
Examiner's Answer mailed Oct. 26, 2016 in co-pending U.S. Appl. No. 13/435,733 40 pages.
U.S. Appl. No. 14/793,907, filed Jul. 8, 2015, Inventor: Croxford et al.
U.S. Appl. No. 15/214,800, filed Jul. 20, 2016, Inventor: Brkic et al.
U.S. Appl. No. 15/254,280, filed Sep. 1, 2016, Inventor: Croxford et al.
UK Search Report dated Jan. 23, 2015 issued in GB 1412520.7, 3 pages.
Cambridge in Colour, "Digital Image Interpolation" 2015 (retrieved Jul. 26, 2016), 12 pages.
P. Turcza et al, "Hardware-Efficient Low-Power Image Processing System for Wireless Capsule Endoscopy" *IEEE Journal of Biomedical and health Informatics*, vol. 17, No. 6, Nov. 2013, pp. 1046-1056.
S.J. Carey et al, "Demonstration of a Low Power Image Processing System using a SCAMP3 Vision Chip" IEEE, Aug. 2011, 2 pages.
Pixelplus Co., Ltd., "Ultra Low-Power & Image-Processing Processor" Brief Sheet, Rev. 2.0, Image ARM Processor, Oct. 27, 2008, 14 pages.
Y. Asada, "Low-Power Technology for Image-Processing LSIs" FUJITSU Sc. Tech. J., vol. 49, No. 1, Jan. 2013, pp. 117-123.
G. Haim et al, "Optimization of Image Processing Algorithms: A Case Study" Feb. 9, 2012, 16 pages.
UK Combined Search and Examination Report issued Jan. 12, 2016 in GB 1512828.3, 5 pages.

(56) References Cited

OTHER PUBLICATIONS

Examiner's Answer mailed Apr. 3, 2014 in co-pending U.S. Appl. No. 12/588,459, 10 pages.
Examiner's Answer mailed Feb. 18, 2016 in co-pending U.S. Appl. No. 12/588,461, 7 pages.
Patent Trial and Appeal Board Decision mailed Sep. 28, 2016 in co-pending U.S. Appl. No. 12/588,459, 7 pages.
Office Action mailed Feb. 13, 2017 in co-pending U.S. Appl. No. 12/588,459, 41 pages.
PTAB Decision on Appeal mailed Feb. 2, 2017 in co-pending U.S. Appl. No. 12/588,461, 10 pages.

* cited by examiner

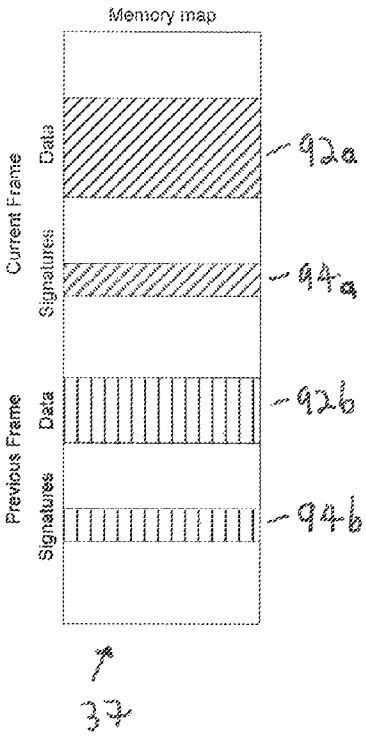
Fig. 4
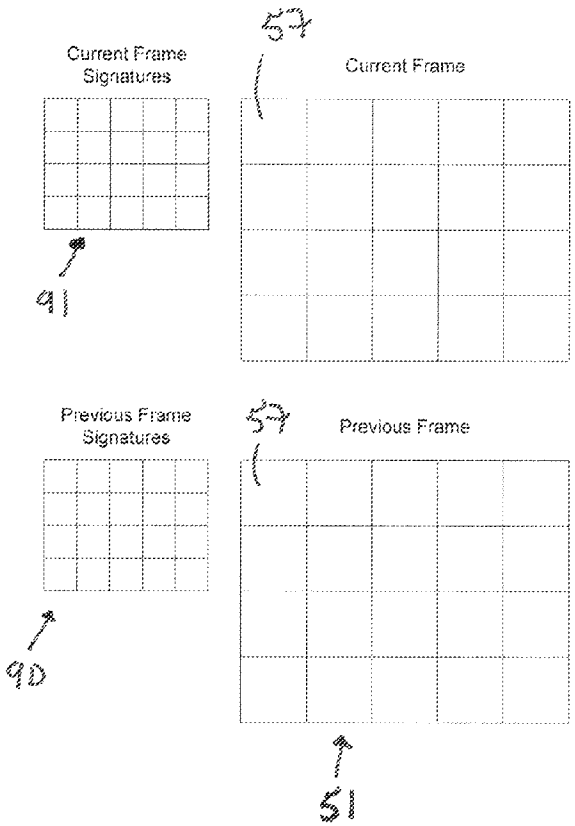

METHOD AND APPARATUS FOR OVERDRIVING BASED ON REGIONS OF A FRAME

This application claims priority to GB Patent Application No. 1402168.7 filed Feb. 7, 2014, the entire content of which is hereby incorporated by reference.

BACKGROUND

The technology described herein relates to a method of and an apparatus for generating an overdrive frame for use when "overdriving" a display.

It is common for electronic devices, such as mobile phones, and for data processing systems in general, to include some form of electronic display screen, such as an LCD panel. To display an output on the display, the pixels (picture elements) of the display must be set to appropriate colour values. This is usually done by generating an output frame to be displayed which indicates, for each pixel or sub-pixel, the colour value to be displayed. In the case of LCD panels, for example, the output frame colour values are then used to derive drive voltage values to be applied to the pixels and/or sub-pixels of the display so that they will then display the desired colour.

It is known that LCD displays, for example, have a relatively slow response time. This can lead to undesirable artefacts, such as motion blur when displaying rapidly changing or moving content, for example.

Various techniques have accordingly been developed to try to improve the response time of LCD (and other, such as OLED) displays. One such technique is referred to as "overdrive". Overdrive involves applying drive voltages to the display pixels and/or sub-pixels that differ from what is actually required for the desired colour, to speed up the transition of the display pixels towards the desired colour. Then, as the pixels and/or sub-pixels approach the "true" desired colour, the drive voltage is set to the actual required level for the desired colour (to avoid any "overshoot" of the desired colour). (This uses the property that liquid crystals in LCD displays are slow to start moving towards their new orientation but will stop rapidly, so applying a relatively "boosted" voltage initially will accelerate the initial movement of the liquid crystals.)

Other terms used for overdrive include Response Time Compensation (RTC) and Dynamic Capacitance Compensation (DCC). For convenience the term overdrive will be used herein, but it will be understood that this is intended to include and encompass all equivalent terms and techniques.

To perform the overdrive operation, an output, "overdrive" frame that is the frame (pixel values) that is sent to the display for display (and thus used to determine the drive voltages to apply to the pixels and/or sub-pixels of the display) is derived. The output, overdrive frame pixel values are based on the pixel values for the next frame (the new frame) to be displayed and the pixel values for the previously displayed frame (or for more than one previously displayed frame, depending on the actual overdrive process being used). The overdrive frame pixel values themselves can be determined, e.g., by means of a calculation or algorithm that uses the new and previous frame(s) pixel and/or sub-pixel values, or by using a look-up table or tables of overdrive pixel values for given new and previous frame(s) pixel and/or sub-pixel values, etc., as is known in the art.

FIGS. 1 and 2 illustrate overdrive operation. FIG. 1 shows a set of input frames to be displayed 10 and the corresponding frames 11 as they are displayed when overdrive is not used. As can be seen in the examples shown in FIG. 1, in the case of the second frame (Frame 2) in the sequence, the displayed frame without using overdrive will be lighter than the intended input frame due to the delay in the LCD display transitioning to the new input frame's colour values.

FIG. 2 then shows the situation where overdrive is used. Again, there is a set of input frames 10, but in this case those input frames are used to calculate a set of overdrive frames 20, that are the frames that are actually sent to the display for display. As shown in FIG. 2, the overdrive frame for Frame 2 is actually darker than the desired input frame, but that results in the displayed pixels in the frame 21 transitioning more rapidly to the required colour (i.e. corresponding to the input frame).

FIG. 3 shows an exemplary data processing system 30 that includes an overdrive engine 31 that generates overdriven frames for provision to a display for display.

As shown in FIG. 3, the data processing system includes a central processing unit (CPU) 32, a graphics processing unit (GPU) 33, a video engine 34, the overdrive engine 31, and a display controller 35 that communicate via an interconnect 36. The CPU, GPU, video engine, overdrive engine and display controller also have access to off-chip memory 37 for storing, inter alia, frames, via a memory controller 38.

The GPU 33 or video engine 34 will, for example, generate a frame for display. The frame for display will then be stored, via the memory controller 38, in a frame buffer in the off-chip memory 37.

When the frame is to be displayed, the overdrive engine 31 will then read the frame from the frame buffer in the off-chip memory 37 and use that frame, together with one or more previously displayed frames to calculate an overdrive frame that it will then store in the off-chip memory 37. The display controller 35 will then read the overdrive frame from the overdrive frame buffer in the off-chip memory 37 via the memory controller 38 and send it to a display (not shown) for display.

FIG. 4 shows the operation of the overdrive engine 31 in more detail. As shown in FIG. 4, the overdrive engine will read the current frame 40 and one or more previous frames 41 from the frame buffers in off-chip memory 37, and use those frames to generate an overdrive frame 42 that it writes into an overdrive frame buffer in the off-chip memory 37. The display controller 35 will then read the overdrive frame 42 from memory and provide it to a display for display.

Although overdrive can improve the response time of a display, the Applicants have recognised that the calculation of the overdrive frame can consume a significant amount of power and memory bandwidth. For example, to calculate the overdrive frame, the next and previous input frame(s) must be fetched and analysed, with the overdrive frame then being written back to memory for use. For example, for a 2048×1536×32 bpp×60 fps display, that accordingly requires 720 MB/s data to be fetched (the display controller fetch) for a given frame, fetching the previous and next input frames, analysing them, and writing out the overdrive frame will require an additional 2.2 GB/s (comprising the new and previous frame fetch and overdrive frame write).

The Applicants believe that there remains scope for improvements to overdrive arrangements for displays.

BRIEF DESCRIPTION OF THE DRAWINGS

Embodiments of the technology described herein will now be described by way of example only and with reference to the accompanying drawings, in which:

FIG. 9 is a schematic diagram illustrating input frames and their corresponding signatures and the storage of this data in memory;

Like reference numerals are used for like features throughout the drawings, where appropriate.

DETAILED DESCRIPTION

Figure 1:
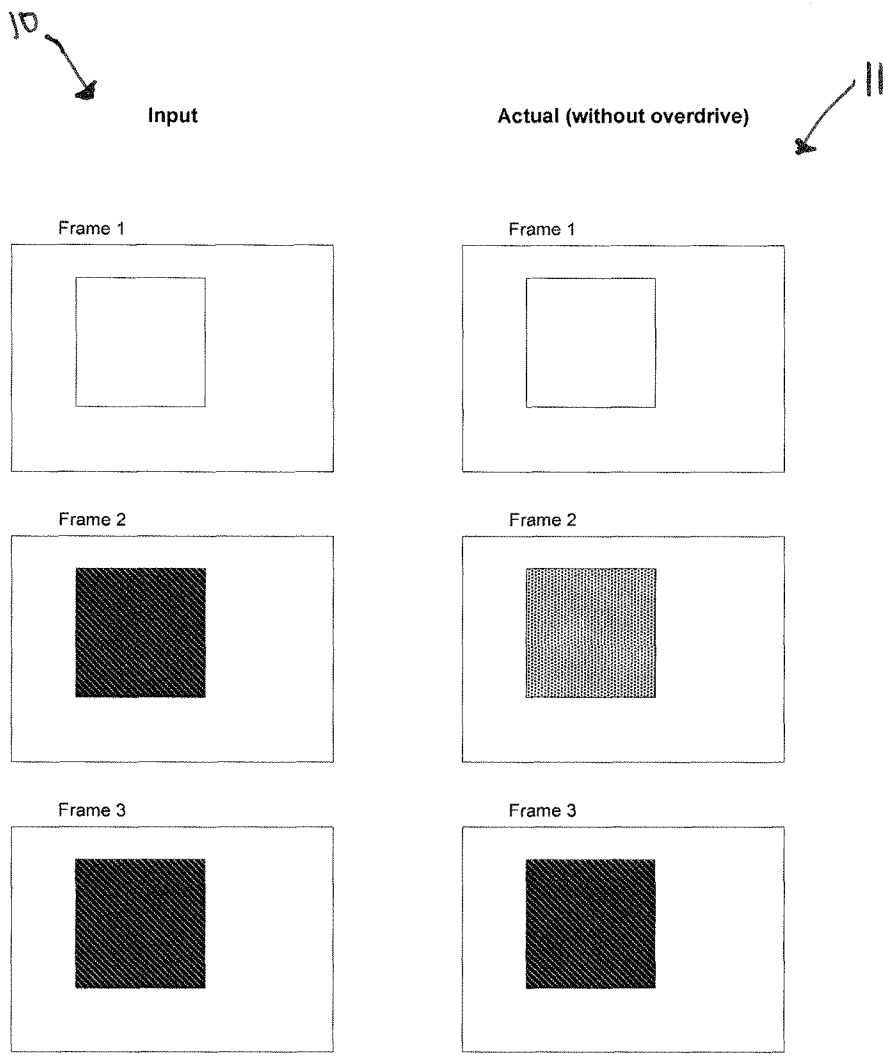
Fig. 1 Prior Art
FIG. 1 shows schematically the display of a series of input frames when overdrive is not being used.
Figure 2:
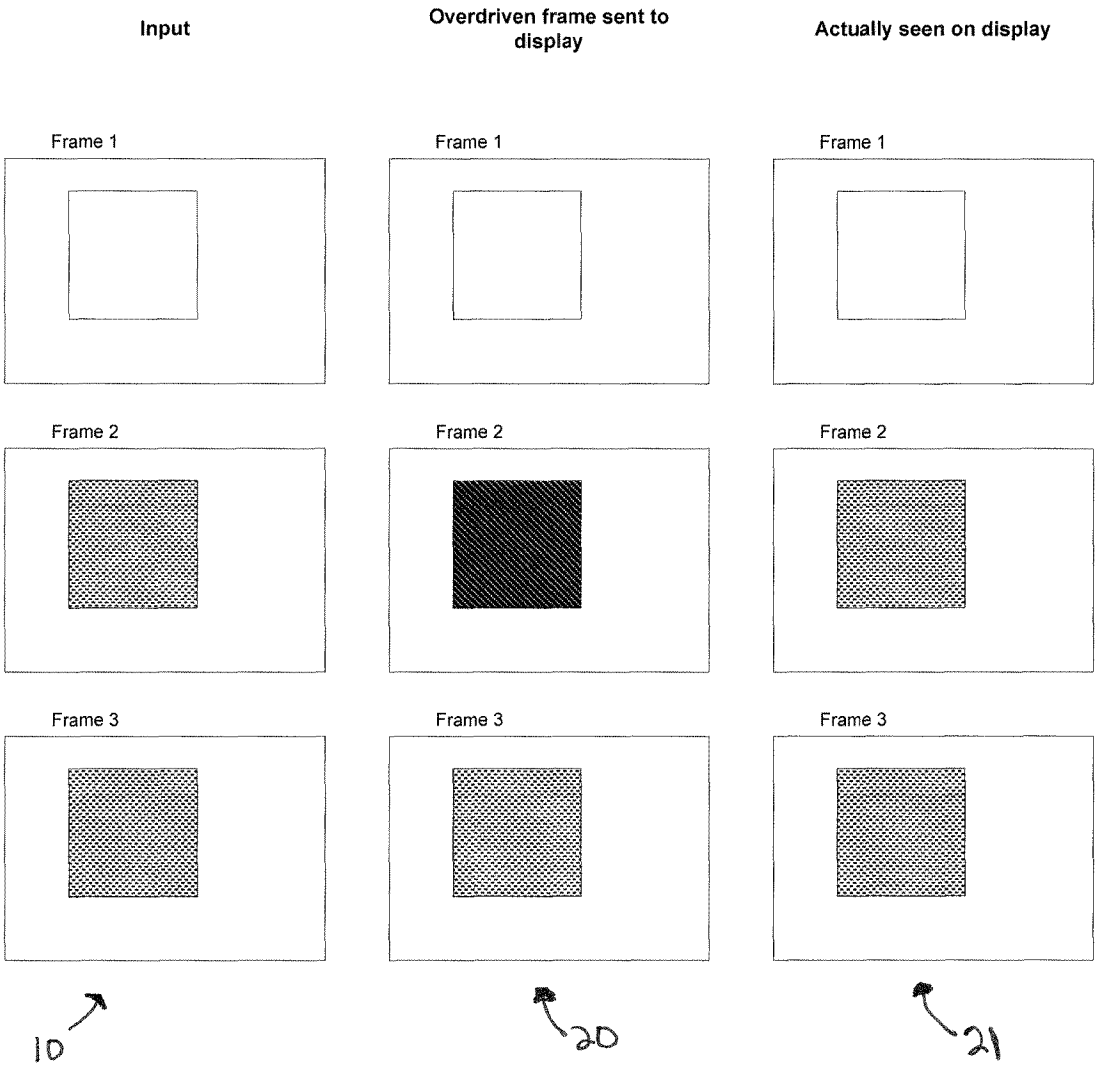
Fig. 2 Prior Art
FIG. 2 shows schematically the display of the series of input frames of FIG. 1 when using overdrive.

A first embodiment of the technology described herein comprises a method of generating an output frame for provision to an electronic display for display from an input frame to be displayed when overdriving an electronic display, the method comprising:

generating the output frame to be provided to the electronic display as one or more respective regions that together form the output frame, each respective region of the output frame being generated from a respective region or regions of the input frame to be displayed; and for at least one region of the output frame:

determining which region or regions of the input frame to be displayed contribute to the region of the output frame;

determining whether the contributing region or regions of the input frame to be displayed have changed since the version of the output frame region that is currently being displayed on the display was generated; and if it is determined that the contributing region or regions of the input frame to be displayed have changed since the version of the output frame region that is currently being displayed on the display was generated, generating an overdriven region for the region of the output frame for provision to the display based on the contributing region or regions of the input frame to be displayed and the contributing region or regions of at least one previous input frame.

A second embodiment of the technology described herein comprises an apparatus for generating an output frame for provision to an electronic display for display from an input frame to be displayed when overdriving an electronic display, the apparatus comprising processing circuitry configured to:

generate an output frame to be provided to an electronic display for display as one or more respective regions that together form the output frame, each respective region of the output frame being generated from a respective region or regions of the input frame to be displayed; and to:

for at least one region of the output frame:

determine which region or regions of the input frame to be displayed contribute to the region of the output frame;

determine whether the contributing region or regions of the input frame to be displayed have changed since the version of the output frame region that is currently being displayed on the display was generated; and if it is determined that the contributing region or regions of the input frame to be displayed have changed since the version of the output frame region that is currently being displayed on the display was generated, generate an overdriven region for the region of the output frame for provision to the display based on the contributing region or regions of the input frame to be displayed and the contributing region or regions of at least one previous input frame.

The technology described herein relates to arrangements in which an output frame for use when overdriving a display is generated by generating respective regions of the output frame from respective regions of the next input frame to be displayed. When a new version of the input frame is to be displayed, it is determined which region(s) of the input frame contribute to (i.e. will be used to generate) a respective region or regions of the output frame, and then checked whether those contributing region or regions of the input frame have changed (in some embodiments, have changed significantly (as will be discussed further below)) since the region or regions of the output frame was last generated. Then, if it is determined that there has been a change in the contributing region or regions of the input frame, an overdriven region for the region of the output surface is generated for providing to the display (such that the display will then accordingly be "overdriven" relative to the actual input frame for that frame region).

Thus, if it is determined that the contributing region(s) have changed in the next frame to be displayed, an overdriven version of the output frame region is generated. On the other hand, the Applicants have recognised that if it is determined that the contributing input frame region(s) have not changed (or at least have not changed significantly), then the output frame region can be formed from the contributing region(s) of the new input frame without the need to overdrive the input frame region(s), such that the previous frame(s) region(s) need not be read from memory and analysed, thereby reducing bandwidth, computation and power consumption. This can lead to significant bandwidth and power savings.

Thus, in a particular embodiment, the technology described herein comprises if it is determined that the contributing region or regions of the input frame to be displayed have not changed since the version of the output frame region that is currently being displayed on the display was generated, not generating an overdriven region for the region of the output frame for provision to the display and using the contributing region or regions of the new input frame to be displayed for the region of the output frame for provision to the display.

The Applicants have recognised that in many cases where frames are being displayed on an electronic device, such as a mobile phone for example, the majority of the frame being displayed may be unchanged as between successive displayed frames. For example, a large proportion of the frame may be unchanged from frame to frame for video, games and graphics content. This could then mean that much of the bandwidth and power used to generate an overdriven version of the frame being displayed (the "overdrive" frame) is in fact unnecessary. The technology described herein addresses this by determining whether the region(s) of the next frame to be displayed that contribute to a given region of the output frame have changed, before an overdrive version of the region of the output frame is generated when a new frame is to be displayed.

The technology described herein can accordingly facilitate using overdrive techniques to improve display response time, whilst reducing, potentially significantly, the power consumption and bandwidth required for the overdrive operation. This therefore facilitates, for example, using overdrive techniques on lower powered and portable devices, such as mobile phones.

The output frame is the frame that is provided to (that is used to drive) the display. As will be appreciated from the above, the output frame may, depending upon the operation of the technology described herein, and in an embodiment does, include both overdriven (overdrive) regions and regions that are not overdriven.

The input frame is the frame that it is desired to display (that should appear on the display).

The input frames to be displayed that are used to generate the output frame may be any suitable and desired frames to be displayed. The (and each) input frame may, e.g., be generated from a single "source" surface (frame), or the input frames that are used to generate the output frame may be frames that are formed by compositing a plurality of different source surfaces (frames). Indeed, in one embodiment the technology described herein is used in a compositing window system, and so the input frames that are used to generate the output frames may be composited frames (windows) for display.

Where the input frames to be displayed are composited (generated) from one or more source surfaces (frames) this can be done as desired, for example by blending or otherwise combining the input surfaces in a compositing window system. The process can also involve applying transformations (skew, rotation, scaling, etc.) to the input surface or surfaces, if desired. This process can be performed by any appropriate component of the data processing system, such as a graphics processor, compositing display controller, composition engine, video engine, etc.

The frames being displayed (and their source surfaces) can be generated as desired, for example by being appropriately rendered and stored into a buffer by a graphics processing system (a graphics processor), a video processing system (video processor), a window compositing system (a window compositor), etc., as is known in the art. The frames may be, e.g., for a game, a demo, a graphical user interface, video, etc., as is known in the art.

It will be appreciated that the technology described herein is particularly applicable to arrangements in which a succession of frames to be displayed are generated (that may, e.g., remain the same, or vary over time (and in an embodiment this is the case)). Thus the technology described herein may comprise generating a succession of input frames to be displayed, and when each new version of the input frame is to be displayed, carrying out the operation in the manner of the technology described herein. Thus, in an embodiment the process of the technology described herein is repeated for plural input frames that are being generated (and as they are generated), and may be as each successive new version of the input frame is displayed. (A new version of the input frame would typically need to be displayed when a new frame for display is required, e.g. to refresh the display. Thus typically, a new output frame for display would be generated at the display refresh rate (e.g. 60 Hz). Other arrangements would, of course, be possible.)

The output frame could be generated as a single region that comprises the entire output frame, but in an embodiment it is generated as a plurality of respective regions that together form the output frame (in which case each respective region will be a smaller part of the overall output frame). Generating the output frame as a plurality of respective regions that together form the output frame increases the opportunity of the operation in the manner of the technology described herein to eliminate bandwidth.

Where the regions of the frames that are considered represent portions (but not all) of the frame in question, then the regions of the frames (whether the input or output frames, or any source frames (surfaces) used to generate an input frame) that are considered and used in the technology described herein can each represent any suitable and desired region (area) of the frame in question. So long as the frame in question is able to be divided or partitioned into a plurality of identifiable smaller regions each representing a part of the overall frame that can be identified and processed in the manner of the technology described herein, then the subdivision of the frames into regions can be done as desired.

In some embodiments, the regions correspond to respective blocks of data corresponding to respective parts of the overall array of data that represents the frame in question (as is known in the art, the frames will typically be represented as, and stored as, arrays of sampling position or pixel data).

All the frames can be divided into the same size and shape regions (and in one embodiment this is done), or, alternatively, different frames could be divided into different sized shapes and regions (for example the input frames to be displayed could use one size and shape region, whereas the output frame could use another size and shape region).

Correspondingly, there may only be a single region from a given frame (e.g. from each input frame to be displayed) that contributes to another frame (e.g. to a region of an output frame region), or there may be two or more regions of a frame (e.g. of each input frame to be displayed) that contribute to a region of another frame (e.g. to an output frame region). The latter may be the case where, for example, the display processes data in scan line order (such that the output frame regions are all or part of respective scan lines), but the regions of the input frames to be displayed are square (such that a number of input frame regions will need to be considered for each (linear) output frame region).

Each frame region (e.g. block of data) in an embodiment represents a different part (region) of the frame (overall data array) in question. Each region (data block) should ideally represent an appropriate portion (area) of the frame (data array), such as a plurality of data positions within the frame. Suitable region sizes could be, e.g., 8×8, 16×16. 32×32, 32×4 or 32×1 data positions in the data array. Non-square rectangular regions, such as 32×4 or 32×1 may be better suited for output to a display.

In some embodiments, the frames are divided into regularly sized and shaped regions (e.g. blocks of data), and may be in the form of squares or rectangles. However, this is not essential and other arrangements could be used if desired.

In some embodiments, each frame region corresponds to a rendered tile that a graphics processor, video engine, display controller, composition engine, etc., that is rendering (generating) the frame produces as its output. This is a particularly straightforward way of implementing the technology described herein, as the e.g. graphics processor will generate the rendering tiles directly, and so there will be no need for any further processing to "produce" the frame regions that will be considered in the manner of the technology described herein.

(As is known in the art, in tile-based rendering, the two dimensional output array or frame of the rendering process (the "render target") (e.g., and typically, that will be displayed to display the scene being rendered) is sub-divided or partitioned into a plurality of smaller regions, usually referred to as "tiles", for the rendering process. The tiles (regions) are each rendered separately (typically one after another). The rendered tiles (regions) then form the complete output array (frame) (render target), e.g. for display.

Other terms that are commonly used for "tiling" and "tile based" rendering include "chunking" (the regions are referred to as "chunks") and "bucket" rendering. The terms "tile" and "tiling" will be used herein for convenience, but it should be understood that these terms are intended to encompass all alternative and equivalent terms and techniques.)

In these arrangements of the technology described herein, the tiles that the frames are divided into can be any desired and suitable size or shape, but at least in some embodiments are of the form discussed above (so may be rectangular (including square), and may be 8×8, 16×16, 32×32, 32×4 or 32×1 sampling positions in size).

In some embodiments, the technology described herein may be also or instead performed using frame regions of a different size and/or shape to the tiles that the e.g. rendering process, etc., operates on (produces).

For example, in some embodiments, the frame regions that are considered in the manner of the technology described herein may be made up of a set of plural "rendering" tiles, and/or may comprise only a sub-portion of a rendering tile. In these cases there may be an intermediate stage that, in effect, "generates" the desired frame regions from the e.g. rendered tile or tiles that the e.g. graphics processor generates.

The technology described herein determines which region or regions of the input frame to be displayed contribute to the region of the output frame in question before checking whether that region or regions has changed (such that an overdriven version of the output frame region should then be generated). This allows the technology described herein to, in particular, take account of the situation where a given region of the output frame may in fact be formed from (using) two or more (a plurality of) input frame regions.

The region or regions of the input frame that contribute to (i.e. will be used for) the region of the output frame in question (and that should then be checked in the manner of the technology described herein) can be determined as desired. In one embodiment this is done based on the process (e.g. algorithm) that is to be used to generate the region of the output frame from the region or regions of the input frame.

For example, where there is a 1:1 mapping of input frame regions (e.g. tiles) to output frame regions (e.g. tiles), the contributing input frame region can simply be determined from knowing which output frame region (e.g. the output frame tile position) is being considered (has been reached). Alternatively, knowledge of how the input frame regions map to the output frame regions can be used to determine which input frame region(s) contribute to an output frame region.

In another embodiment, a record is maintained of the input frame region or regions that contributed to (have been used to generate) each respective output frame region, and then that record is used to determine which region or regions of the input frame contribute to the region of the output frame in question. The record may, for example, comprise data, such as meta data, representing which region or regions of the input frame contribute to a region of the output frame. The data may specify a list of coordinates or other labels representing the region or regions, for example.

In this case, a record could be maintained, for example, of those input frame regions that contribute to the output frame region (and in an embodiment this is done), or the record could indicate the input frame regions that do not contribute to the output frame region.

The step of checking whether the determined contributing region or regions of the input frame to be displayed have changed since the version of the output frame region that is currently being displayed was generated (since the previous version of the output frame region was generated) can be performed in any desired and suitable manner.

In one embodiment, each contributing input frame region is checked individually. Alternatively, plural input frame regions (in the case where there are plural contributing input frame regions), such as all the contributing input frame regions, could be checked as a whole.

In one embodiment it is checked whether the contributing input frame region or regions have changed by checking (using) the input frame region(s) themselves, may be by comparing the respective versions of the input frame regions to determine if the input frame regions have changed.

Thus, in one embodiment the checking of whether a contributing region of the input frame to be displayed has changed since the previous version of the output frame region was generated is performed by comparing the current version of the region of the input frame to be displayed (i.e. that will be used to generate the new version of the output frame region to be generated) with the version of the region of the input frame to be displayed that was used to generate the previous version of the output frame region (to see if the region of the input frame to be displayed has changed). To facilitate this, the previous version of the frame or frame region could, e.g., be stored once it is generated, or regenerated, if required and appropriate.

In another embodiment, the step of checking whether the determined contributing region or regions of the input frame to be displayed have changed comprises determining whether the respective region or regions of one or more input surfaces that contribute to the contributing region or regions of the input frame have changed. This will then comprise, rather than comparing the different versions of the input frame regions themselves, comparing different versions of the source frame regions that are used to generate the respective input frame regions (e.g. in a windows compositing system).

In this embodiment, the checking of whether a contributing region of a source surface that contributes to a region of the input frame has changed since the previous version of the output frame region was generated may be accordingly performed by comparing the current version of the region of the source surface (frame) with the version of the region of the source surface (frame) that was used to generate the previous version of the input frame region (to see if the region of source surface (frame) has changed).

In this case, it may accordingly be necessary to determine which region or regions of the source surface or surfaces (frame or frames) contribute to the input frame region or regions in question. This determination of the contributing source frame (surface) regions can again be performed in any desired manner, for example based on the process (e.g. algorithm) that is to be used to generate the region of the input frame from the region or regions of the source surfaces. In this case, the determination may, for example, be based on the compositing algorithm (process) that is being used.

Alternatively, as discussed above, a record could be maintained of the source frame region or regions that contributed to (have been used to generate) each respective input frame region, and then that record used to determine which region or regions of the source frames contribute to the region of the input frame in question (e.g., in the manner discussed above).

Where it is being determined whether the respective region or regions of one or more source surfaces that contribute to the contributing region or regions of the input frame have changed, then in an embodiment the check as to whether the source surface regions are changed is only performed for those source surface regions that it has been determined will be visible in the input frame region. This avoids performing any redundant processing for source surface regions which will not in fact be visible in the input frame region. In an embodiment only the source surface regions which will be visible in the input frame region are considered to be input surface regions that will contribute to the input frame region and so checked to see if they have changed. Source surface regions may not be visible in an input frame region because, for example, they are behind other opaque source surfaces that occlude them.

The determining of whether a frame region has changed could be configured to determine that the frame region has changed if there is any change whatsoever in the frame region.

Thus, the determining of whether a contributing region or regions of the input frame have changed since the previous version of the output frame region was generated could be configured to determine that the input frame region or regions have changed if there is any change whatsoever in the input frame region or regions. In this case, it will only be determined that a contributing input frame region has not changed if the new version of the region is the same as (identical to) the previous version of the region.

However, in an embodiment, it is only determined that a frame region has changed if the new version of the region differs from a previous version of the region by more than a particular, e.g. selected, amount (i.e. if there is a more significant change in the frame region). Correspondingly, in an embodiment, only certain, but not all changes, in a frame region trigger a determination that a frame region has changed.

Thus, in an embodiment, the step of checking whether the determined contributing region or regions of the input frame have changed since the previous version of the output frame region was generated is configured to only determine that the contributing region or regions of the input frame have changed if there has been a change that is greater than a particular, e.g. selected, e.g. predetermined, threshold amount in the contributing input frame region (or in at least one of the contributing input frame regions where there is more than one).

Correspondingly, in an embodiment, the step of checking whether a frame region has changed is performed by assessing whether the new version of the frame region is sufficiently similar to the previous version of the frame region or not.

The Applicants have recognised in this regard that where overdrive is being performed, then it may be desirable to disable (to not use) the overdrive operation where there are only small differences between the pixels and/or sub-pixels of the previous and next frames to be displayed, so as, e.g., to avoid or reduce emphasising differences that may be caused by noise.

One way to achieve this in the system of the technology described herein is to treat frame regions that are only slightly different to each other as being determined to have not changed. This could be achieved, for example, and in an embodiment is achieved, by determining whether the new and previous frame regions differ from one another by a particular, e.g. selected, threshold amount or not (with the frame region then being considered not to have changed if the difference is less than, or less than or equal to, the threshold). As will be discussed further below, in an embodiment this is implemented by, effectively, ignoring any changes in the least significant bit and/or a selected number of the least significant bits, of the data (e.g. colour) values for the region of the frame in question. Thus, in an embodiment, it is determined whether there have been any changes in a particular, e.g. selected, set of the most significant bits of the data (e.g. colour) values for the region of the frame in question.

The determination of whether the new version of a frame region is the same as or similar to the previous version of the frame region or not can be done in any suitable and desired manner. Thus, for example, some or all of the content of the region in the new frame may be compared with some or all of the content of the previously used version of the region of the frame (and in some embodiments this is done).

In some embodiments, the comparison is performed by comparing information representative of and/or derived from the content of the current version of the frame region in question with information representative of and/or derived from the content of the version of that frame region that was used previously, e.g., to assess the similarity or otherwise of the versions of the regions of the frame.

The information representative of the content of a region of a frame may take any suitable form, but may be based on or derived from the content of the respective frame region. In some embodiments, it is in the form of a "signature" for the region which is generated from or based on the content of the frame region in question (e.g. the data block representing the region of the frame). Such a region content "signature" may comprise, e.g., any suitable set of derived information that can be considered to be representative of the content of the region, such as a checksum, a CRC, or a hash value, etc., derived from (generated for) the data for the frame region in question. Suitable signatures would include standard CRCs, such as CRC32, or other forms of signature such as MD5, SHA-1, etc.

Thus, in some embodiments, a signature indicative or representative of, and/or that is derived from, the content of each frame region is generated for each frame region that is to be checked, and the checking process comprises comparing the signatures of the respective versions of the region(s) of the frame (e.g. to determine whether the signature representing the respective versions of the region in question has changed, e.g. since the current version of the output frame region was generated).

The signature generation, where used, may be implemented as desired. For example, it may be implemented in an integral part of the, e.g., graphics, processor that is generating the frame, or there may, e.g., be a separate "hardware element" that does this.

The signatures for the frame regions may be stored appropriately, and associated with the regions of the frame to which they relate. In some embodiments, they are stored with the frames in the appropriate, e.g., frame, buffers. Then, when the signatures need to be compared, the stored signature for a region may be retrieved appropriately.

As will be appreciated, it may be desirable to check whether each respective contributing region of the input frame to be displayed has changed since the previous version of the output frame region was generated. Thus, in some embodiments, for each region of the input frame to be displayed that it has been determined will contribute to the output frame region and so should be checked to see if it has changed, the current version of that region of the input frame to be displayed is compared (e.g., by means of a signature comparison process) to the version of that region of the input frame that was used to generate the previous version of the output frame region, to determine if the region of the input frame to be displayed has changed.

Correspondingly where two or more previous versions of the input frame to be displayed are used in the overdrive scheme being used, the determined contributing regions in each version of the input frame being displayed may be checked (and if there has been an appropriate change in the contributing region or regions of the input frame to be displayed since the previous version of the output frame region was generated, then an overdriven version of the region of the output frame will be generated).

In this case, the comparisons between each set of frames could be performed in the same way, or, for example, the comparison between the current and immediately preceding frames might be different (e.g. subject to different criteria and/or use different data (e.g. be at a higher level of precision)) to the comparisons for or with earlier preceding frames. For example, for the current and previous frames, the top six bits of each colour could be compared to see if there is a difference (e.g. by using signatures based on the top six bits), but when comparing the frame or frames before that, the same number of bits could be compared, or fewer bits (e.g. just the top two bits) could be compared.

As discussed above, the checking process may, e.g., require an exact match for a frame region to be considered not to have changed, but only a sufficiently similar (but not exact) match, e.g., that does not exceed a given threshold, may be required for the region to be considered not to have changed.

The frame region comparison process can be configured as desired and in any suitable way to determine that the frame region has changed if the change in the frame region is greater than a particular, e.g. selected amount (to determine if the differences in the frame region are greater than a, e.g. selected amount).

For example, where signatures indicative of the content of the frame regions are compared, then depending upon the nature of the signatures involved, a threshold could be used for the signature comparison processes to ensure that only small changes in the frame regions (in the frame region's signature) are ignored (do not trigger a determination that the frame region has changed). In one embodiment, this is what is done.

Additionally or alternatively, the signatures that are compared for each version of a frame region could be generated using only selected, more significant bits (MSB), of the data in each frame region (e.g. R[7:2], G[7:2] and B[7:2] where the frame data is in the form RGB888). Thus, in an embodiment, the signatures that are compared are based on a selected set of the most significant bits of the data for the frame regions. If these "MSB" signatures are then used to determine whether there is a change between frame regions, the effect will then be that a change is only determined if there is a more significant change between the frame regions.

In this case, a separate "MSB" signature may be generated for each frame region for the overdrive process.

Alternatively or in addition, in a system where "full" signatures (e.g. CRC values) using all the data for a frame region are required (e.g. for other purposes) as well as frame region signatures being required for the overdrive operation of the technology described herein, then in an embodiment both a single full signature and one or more separate smaller signatures (each may be representative of particular sets of bits from the frame region data) may be provided for each frame region.

For example, in the case of RGB 888 colours, as well as a "full" R[7:0], G[7:0], B[7:0] signature, one or more "smaller" separate signatures could also be provided (e.g. a first "MSB colour" signature based on the MSB colour data (e.g. R[7:4], G[7:4], B[7:4]), a second "mid-colour" signature (R[3:2], G[3:2], B[3:2]), and a third "LSB colour" signature (R[2:0], G[2:0], B[2:0]).

In this case, the separate MSB colour, mid-colour, and LSB colour signatures could be generated and then concatenated to form the "full signature" when that is required, or, if the signature generation process permits this, a single "full" colour signature could be generated which is then divided into respective, e.g., MSB colour, mid-colour and LSB colour signatures.

In this case, the MSB colour signature, for example, could be used for the overdrive operation of the technology described herein, but the "full" colour signature could be used for other purposes, for example.

As discussed above this arrangement will stop small differences in the frame regions triggering the overdrive operation. This will then avoid overdriving small differences between frame regions (which small differences will typically be caused by noise). This will also avoid frame regions with only small changes being read in and used in an overdrive calculation, thereby saving more power and bandwidth. This is achieved by only looking at (using) the more important data in the frame region to determine if the frame region has changed.

In an embodiment, the trigger (threshold) for determining that a frame region has changed can be varied in use, e.g., dependent upon the type of content that is being processed. This can then allow the overdrive process of the technology described herein to take account of the fact that different types of content, for example, may require different levels and values of overdrive. For example, video, graphics and GUI (Graphical User Interface) all have different characteristics and can therefore require different overdrive operations.

Thus, in an embodiment, the type of content being displayed is determined, and the process of the technology described herein is configured based on the determined type of content that is to be displayed. In this case, the system could automatically determine the type of content that is being displayed (to do this, the frames being displayed may be analysed, for example, or, for example, the colour space being used could be used to determine the type of content (e.g. whether it is YUV (may be indicative of a video source) or RGB (which may be indicative of a graphics source)), or this could be indicated, e.g., by the user (by the application that is generating the frames for display).

In an embodiment, the frame region comparison process is modified and determined based on the type of content that is being displayed. For example, the number of MSB bits used in the signatures representative of the content of the frame regions that are then compared is configured based on the type of content being displayed. This could be done, e.g., either by selecting from existing generated content indicating signatures, or by adjusting the signature generation process, based on the type of content that is being displayed.

In an embodiment, the frame region comparison (e.g. signature generation and/or comparison) process can also or instead be varied and configured based on whether the frame region in question is determined to be expected to be changing rapidly or not. This may be done by detecting whether the frame region contains an edge in the image or not. (The edge detection can be performed as desired, for example by the device generating the data (e.g. GPU or video engine), with edge detection coefficient metadata then being provided for each frame region. Alternatively edge detection could be performed by the display controller.)

Again, if it is determined that the frame region is changing rapidly (e.g. contains an image edge), then the signature comparison and/or generation process, etc., may be configured accordingly, e.g. by selecting the number of most significant bits that should be compared to determine if overdrive should be performed.

Thus, in an embodiment, the determination of whether the frame region has changed (and e.g. the signature comparison process that is used to determine whether a frame region has changed) can be configured and varied on a frame-by-frame basis, for respective frame regions within a frame, and/or based on the content or nature of the frame being displayed.

In an embodiment, as well as or instead of (and may be as well as) determining whether respective input frame regions have changed, it is also possible to perform the determination for larger areas of an input frame, for example, for areas that encompass plural regions of the input frame, and/or for the input frame as a whole.

In this case, in an embodiment, content representing signatures are also generated and stored for the respective larger areas (e.g. for the entire input frame) of the input frame that could be considered.

This may be done when it can be determined that the input frame is not changing or has not changed for a given period of time (e.g., for a given number of preceding frames). Thus, in an embodiment, if it is determined that the input frame has not changed for a given number of preceding frames, the overdrive process of the technology described herein then determines whether a larger area or areas of an input frame (and may be whether the input frame as a whole) has changed, so as to trigger (or not) the overdrive operation. In this case, the determination of whether the input frame has changed (e.g. for a preceding number of frames), can be determined as desired, e.g. by comparing content representing signatures for the respective versions of the input frame as a whole.

Alternatively or additionally, in an embodiment, when the number of regions from a given input frame that contribute to an output frame region, or from a source frame or frames that contribute to an input frame region, exceeds a particular, e.g. selected, e.g. predetermined, threshold number of frame regions, then instead of comparing each input frame region individually to determine if it has changed, a larger area of the input frame, e.g., the input frame as a whole, may be compared to determine if it has changed, and then a decision as to whether the individual frame regions have changed is made accordingly.

The system of the technology described herein may also be configured such that if certain, e.g. selected, e.g. predetermined, criteria or conditions are met, then rather than checking whether any of the input frame regions have changed, an overdriven version of the output frame region is simply generated without performing any check as to whether any of the input frame regions have changed. This will then allow the input frame region checking process to be omitted in situations where, for example, that process may be relatively burdensome.

The criteria for simply generating an overdriven version of the output frame region can be selected as desired. In an embodiment, these criteria include one or more of and may be all of the following: if the number of input frame regions that contribute to an output frame region exceeds a particular, e.g. selected, e.g. predetermined, threshold number; if the number of source surface (frame) regions that contribute to an input frame region exceeds a particular, e.g. selected, e.g. predetermined, threshold number; if the number of source surfaces (frames) that contribute to a given input surface region exceeds a particular, e.g. selected, e.g. predetermined threshold number; if it is determined that the probability of the input surface region changing between generated versions of the output frame exceeds a given, e.g. selected, threshold value (this may be appropriate where the input frame or input frame region comprises video content); and where the input frame region is generated (composited) from a plurality of source surfaces (frames): if any transformation that is applied to a source surface whose regions contribute to the input surface region changes, if the front-to-back ordering of the contributing source surfaces for an input surface region changes, and/or if the set of source surfaces or the set of source surface regions that contribute to an input surface region changes.

In these arrangements, the respective output frame regions for which the input frame regions will not be checked, may, e.g., be marked, e.g. in metadata, as not to be checked.

As discussed above, if it is determined that the input surface region or regions that contribute to an output surface region have changed, then an overdriven region is generated for the output surface region in question using the input frame region or regions (so as to overdrive the display for the output frame region in question).

The overdrive frame region should comprise the values required to drive the display to get the display image to change more rapidly to the desired input frame. The overdrive frame region values may therefore depend upon what is to be displayed (the new input frame to be displayed) and what was previously displayed.

In an embodiment, the overdriven version of the input frame region(s) that is used for the output frame region is based on the appropriate region(s) (and/or parts of the region(s)) in the new input frame to be displayed and on at least one previous version of the input frame region(s) (and/or parts of the region(s)) and may be on at least the version of the input frame region(s) (and/or parts of the region(s)) in the immediately preceding input frame.

The overdriven output frame region may be generated from the input frame region(s) in any suitable and desired manner, e.g. depending upon the particular overdrive technique that is being used. This may be done using any suitable and desired "overdrive" process.

In an embodiment, the overdriven version of the input frame region(s) that is used for the output frame region depends upon the input frame region(s) (and/or parts of the regions) in the new input frame to be displayed and in one, or in more than one, previous versions of the input frame region(s). Correspondingly, the actual pixel and/or sub-pixel value that is used for a pixel and/or sub-pixel in the overdriven output frame region (that is driven) may depend upon the pixel and/or sub-pixel value (colour) in the new input frame to be displayed and in one, or in more than one, previous versions of the input frame. In an embodiment, the overdriven version of the input frame region(s) (the overdriven pixel and/or sub-pixel values) also depend upon the display's characteristics.

The overdriven values may, for example, and in one embodiment are, determined by a function that determines the output pixel value depending upon the new and previous pixel values and, e.g., the display characteristics. In another embodiment, a stored set of predetermined overdrive values are stored (e.g. in a lookup table) in association with corresponding new and previous pixel values and then the current new and previous pixel values are used to fetch the required overdrive value from the stored values (from the lookup table) as required. In this latter case, some form of approximation (e.g. linear approximation) may be used to reduce the size of the stored set of values (of the lookup table), if desired.

It will be appreciated here that an overdrive pixel value may be larger or smaller than the actual desired pixel value, depending upon in which "direction" the display pixel is to be driven.

In one embodiment, the overdriven version of the input frame region(s) that is used for the output frame is based on the appropriate region(s) (and/or parts of the region(s)) in the next input frame to be displayed and in the previous version of the input frame (the immediately preceding input frame). In this case there will be one (and only one) previous version of the input frame that is used to generate the overdriven input frame region that is used in the output frame.

It is also known to use overdrive schemes that compare n-previous frames. Examining multiple previous frames can allow more accurate prediction of what the current actually displayed frame pixel values are, thereby allowing more accurate determination of what the overdrive pixel values should actually be. Thus, in another embodiment, the overdriven frame region is based on the next input frame to be displayed and a plurality of previously displayed input frames. In this case there will be plural previously displayed input frames that are used to generate the overdrive frame region. In this case, in an embodiment, only the previous frames that are determined to be sufficiently different from the current and/or other previous frames may be used for the overdriven output frame region calculation (are fetched for the overdriven output frame region calculation).

In an embodiment the overdriven output frame region generation is dependent upon one or more of: the type of content that is being displayed; and whether the output frame region in question is determined as being likely to change (e.g. whether the output frame region in question is determined as containing an image edge), as discussed above in relation to the determination of whether the input frame region has changed or not.

The above discusses the situation where an overdriven version of the output frame region is required. On the other hand, if it is determined that there has not been a change in the contributing input surface region or regions since the previous version of the output surface region was generated, then the region of the output frame should not be overdriven, but rather the relevant contributing input surface region or regions (or relevant parts of the contributing input frame region or regions) should be used, and may be used, directly to form (to generate) the output surface region (i.e. without performing any form of overdrive calculation, or applying any form of overdrive to, the input frame regions when generating the output frame region). This then avoids the need to fetch the previous input frame region(s) from memory (and in this case the previous input frame(s) region(s) are not fetched from memory) and to perform any overdrive calculation, for output frame regions that it is determined should not have significantly changed, thereby saving memory bandwidth and power.

Although the technology described herein has been described above with particular reference to the processing of a single region of the output frame, as will be appreciated by those skilled in the art, where the output frame is made up of (is being processed as) plural regions, the technique of the technology described herein can be, and may be used for plural, e.g. for each, respective region of the output frame. Thus, in an embodiment, plural regions of, e.g. each region of, the output frame are processed in the manner of the technology described herein. In this way, the whole output frame that is provided to the display for display (that is used to drive the display) will be generated by the process of the technology described herein.

In an embodiment only output frame regions that have been overdriven are stored in memory, with output frame regions that have not been overdriven being fetched instead directly from the new input frame. This will then avoid or reduce storing again output frame regions that are not being overdriven. In this case, metadata may be used to indicate if an output frame region has been overdriven or not (to thereby trigger the fetching of the corresponding input frame region from the new input frame in the case where the output frame region has not been overdriven).

The technology described herein can be implemented in any desired and suitable data processing system that is operable to generate frames for display on an electronic display. It can be applied to any form of display that "overdrive" is applicable to and used for, such as LCD and OLED displays. The system may include a display, which may be in the form of an LCD or an OLED display.

In an embodiment the technology described herein is implemented in a data processing system that is a system for displaying windows, e.g. for a graphical user interface, on a display, and may be a compositing window system.

The data processing system that the technology described herein is implemented in can contain any desired and appropriate and suitable elements and components. Thus it may contain one or more of, or all of: a CPU, a GPU, a video processor, a display controller, a display, and appropriate memory for storing the various frames and other data that is required.

The input frame region checking process and any required overdrive calculation and overdriven output frame region generation can be performed by any suitable and desired component of the overall data processing system. For example, this could be performed by a CPU, GPU or separate processor (e.g. ASIC) provided in the system (in the system on-chip) or by the display controller for the display in question. It would also be possible for the display itself to perform any or all of these processes if the display has that capability (e.g. is "intelligent" and, e.g., supports direct display composition and has access to appropriate memory). The same element could perform all the processes, or the processes could be distributed across different elements of the system, as desired.

In an embodiment, the input frame region checking process and any required overdrive calculation, etc., of the technology described herein is performed in a display controller and/or in the display itself. Thus the technology described herein also extends to a display controller that incorporates the apparatus of the technology described herein and that performs the method of the technology described herein, and to a display that itself incorporates the apparatus of the technology described herein and that performs the method of the technology described herein.

The input frame(s) and the output frame (and any other source surface (frames)) can be stored in any suitable and desired manner in memory. They may be stored in appropriate buffers. For example, the output frame may be stored in an output frame buffer.

The output frame buffer may be an on-chip buffer or it may be an external buffer (and, indeed, may be more likely to be an external buffer (memory), as will be discussed below). Similarly, the output frame buffer may be dedicated memory for this purpose or it may be part of a memory that is used for other data as well. In some embodiments, the output frame buffer is a frame buffer for the graphics processing system that is generating the frame and/or for the display that the frames are to be displayed on.

Similarly, the buffers that the input frames are first written to when they are generated (rendered) may comprise any suitable such buffers and may be configured in any suitable and desired manner in memory. For example, they may be an on-chip buffer or buffers or may be an external buffer or buffers. Similarly, they may be dedicated memory for this purpose or may be part of a memory that is used for other data as well. The input frame buffers can be, e.g., in any format that an application requires, and may, e.g., be stored in system memory (e.g. in a unified memory architecture), or in graphics memory (e.g. in a non-unified memory architecture).

In an embodiment, each new version of an input frame may be written into a different buffer to the previous version of the input frame. For example, new input frames may be written to different buffers alternately or in sequence.

The input frames from which the output frame is formed may be updated at different rates or times to the output frame. The appropriate earlier version or versions of the input frame should be compared with the current version of the input frame (and used for any overdrive calculation) where and if appropriate. The generation of the output frames may be performed at the display refresh rate. Thus, for example, if input frames are generated at 30 fps but the display is refreshed at 60 fps, the same input frame will be displayed twice. In this case, the first time the overdrive process reads a version of the input frame it will compare the previous and new frames and perform overdrive, but for the next frame the "new" and previous frames will be the same. The input frame generation rate may change depending upon the complexity of the content, but the display refresh rate will most likely be fixed in a practical system.

Although the technology described herein has been described above with particular reference to the idea of determining whether to perform overdrive or not for regions of an output frame on an output frame region-by-region basis, the Applicants have also recognised that there could be advantages to performing the overdrive calculation and operation directly in a display controller (where the display controller is capable of doing that), irrespective of whether the above described techniques of the technology described herein are used or not. For example, if the overdrive operation is performed in the display controller directly, then as the output, overdrive frame can be displayed directly, it would not have to be written to memory for subsequent retrieval by a display controller, thereby saving on the memory bandwidth for reading and writing the overdrive frame. The Applicants believe that this may be new and advantageous in its own right.

Thus, a further embodiment of the technology described herein comprises a method of operating a display controller to generate an output frame for provision to an electronic display for display from an input frame to be displayed when overdriving the electronic display, the method comprising the display controller:

when a new version of the input frame is to be displayed, generating an overdriven version of the input frame for provision to the electronic display by using the new input frame to be displayed and at least one previous input frame to generate the overdriven version of the input frame.

A further embodiment of the technology described herein comprises a display controller for generating an output frame for provision to an electronic display for display from an input frame to be displayed when overdriving the electronic display, the display controller comprising processing circuitry configured to, when a new version of the input frame is to be displayed:

read the new input frame to be displayed and at least one previous input frame from memory;

generate an overdriven version of the new input frame to be displayed, using the read new input frame to be displayed and at least one previous input frame; and to provide the overdriven version of the new input frame to be displayed to a display.

As will be appreciated by those skilled in the art, these embodiments of the technology described herein can and may include any one or more or all of the above described features of the technology described herein, as appropriate. Thus, for example, in an embodiment, the display controller of the technology described herein uses the signature comparison process discussed above to determine if regions of the input frame have changed when generating the overdriven version of the new input frame (and to thereby avoid generating overdriven regions of an input frame that has not changed, for example).

In these embodiments of the technology described herein, the display controller should, e.g., read the current input frame to be displayed and the required previous input frame or frames from appropriate frame buffers in memory and then perform an overdrive calculation using those input frames (e.g. to apply an overdrive factor to the new version of the input frame that is to be displayed), and then provide the overdriven input frame (the overdrive frame) directly to the display for display.

The technology described herein can be implemented in any suitable system, such as a suitably configured microprocessor based system. In some embodiments, the technology described herein is implemented in computer and/or micro-processor based system.

The various functions of the technology described herein can be carried out in any desired and suitable manner. For example, the functions of the technology described herein can be implemented in hardware or software, as desired. Thus, for example, the various functional elements and modules of the technology described herein may comprise a suitable processor or processors, controller or controllers, functional units, circuitry, processing logic, microprocessor arrangements, etc., that are operable to perform the various functions, etc., such as appropriately dedicated hardware elements (processing circuitry) and/or programmable hardware elements (processing circuitry) that can be programmed to operate in the desired manner. Similarly, the display that the windows are to be displayed on can be any suitable such display, such as a display screen of an electronic device, a monitor for a computer, etc.

It should also be noted here that, as will be appreciated by those skilled in the art, the various functions, etc., of the technology described herein may be duplicated and/or carried out in parallel on a given processor. Equally, the various processing stages may share processing circuitry, etc., if desired.

The technology described herein is applicable to any suitable form or configuration of graphics processor and renderer, such as processors having a "pipelined" rendering arrangement (in which case the renderer will be in the form of a rendering pipeline). It is particularly applicable to tile-based graphics processors, graphics processing systems, composition engines and compositing display controllers.

It will also be appreciated by those skilled in the art that all of the described embodiments of the technology described herein can include, as appropriate, any one or more or all of the features described herein.

The methods in accordance with the technology described herein may be implemented at least partially using software e.g. computer programs. It will thus be seen that when viewed from further embodiments the technology described herein comprises computer software specifically adapted to carry out the methods herein described when installed on data processing module or a data processor, a computer program element comprising computer software code portions for performing the methods herein described when the program element is run on data processing module or a data processor, and a computer program comprising code adapted to perform all the steps of a method or of the methods herein described when the program is run on a data processing system. The data processing system may be a microprocessor, a programmable FPGA (Field Programmable Gate Array), etc.

The technology described herein also extends to a computer software carrier comprising such software which when used to operate a data processing system, a graphics processor, renderer or other system comprising data processing module or a data processor causes, in conjunction with said data processing module or data processor, said processor, renderer or system to carry out the steps of the methods of the technology described herein. Such a computer software carrier could be a physical storage medium such as a ROM chip, CD ROM, RAM, flash memory, or disk, or could be a signal such as an electronic signal over wires, an optical signal or a radio signal such as to a satellite or the like.

It will further be appreciated that not all steps of the methods of the technology described herein need be carried out by computer software and thus from a further broad embodiment the technology described herein comprises computer software and such software installed on a computer software carrier for carrying out at least one of the steps of the methods set out herein.

The technology described herein may accordingly suitably be embodied as a computer program product for use with a computer system. Such an implementation may comprise a series of computer readable instructions fixed on a tangible, non-transitory medium, such as a computer readable medium, for example, diskette, CD ROM, ROM, RAM, flash memory, or hard disk. It could also comprise a series of computer readable instructions transmittable to a computer system, via a modem or other interface device, over either a tangible medium, including but not limited to optical or analogue communications lines, or intangibly using wireless techniques, including but not limited to microwave, infrared or other transmission techniques. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical, or transmitted using any communications technology, present or future, including but not limited to optical, infrared, or microwave. It is contemplated that such a computer program product may be distributed as a removable medium with accompanying printed or electronic documentation, for example, shrink wrapped software, pre loaded with a computer system, for example, on a system ROM or fixed disk, or distributed from a server or electronic bulletin board over a network, for example, the Internet or World Wide Web.

A number of embodiments of the technology described herein will now be described.

As discussed above, the technology described herein relates to systems in which overdriven frames are generated for provision to a display so as to compensate for poor responsiveness of the display.

Figure 4:
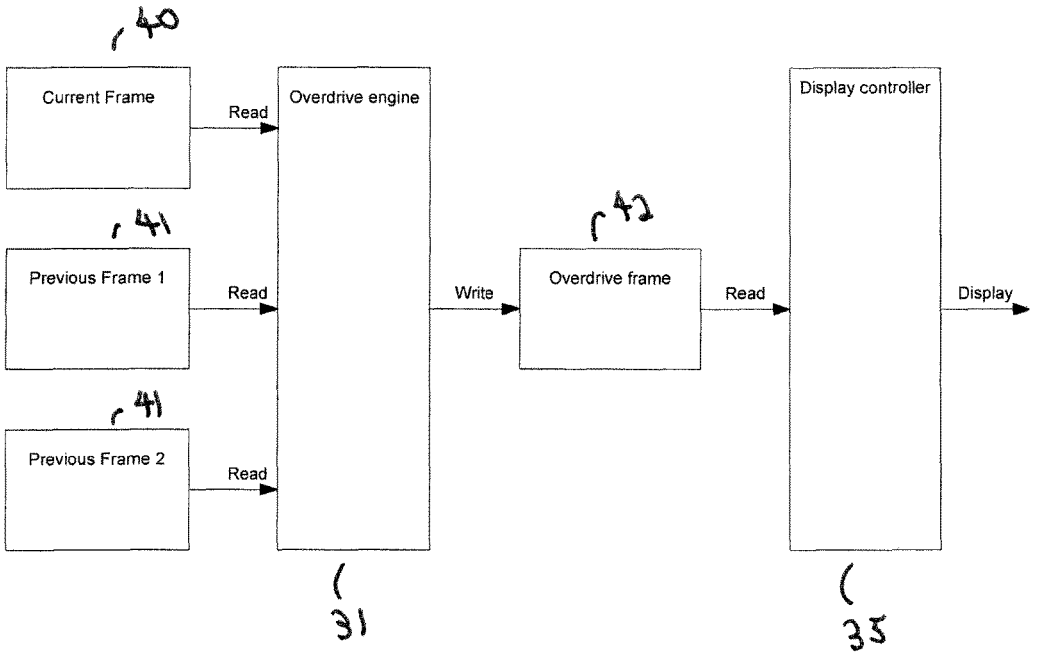
Fig. 4 Prior Art
FIG. 4 shows schematically an overdrive process.
Figure 5:
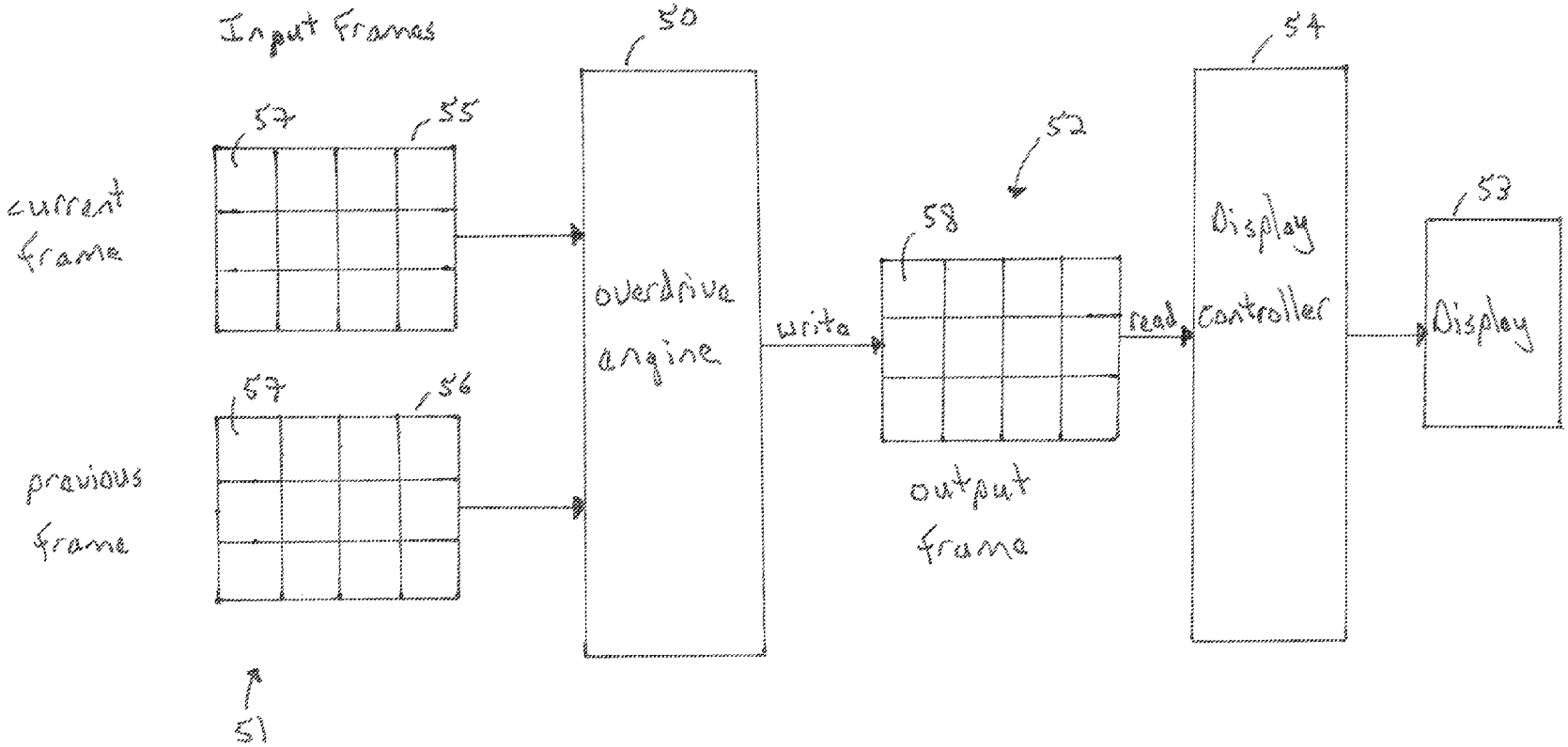
FIG. 5 shows schematically the overdrive process used in embodiments of the technology described herein.

FIG. 5 shows schematically the basic operation of the present embodiments. This is similar to the overdrive operation described above with reference to FIG. 4, but with a number of important differences.

As shown in FIG. 5, an "overdrive engine" 50 takes input frames 51 (which are frames to be displayed), and for each input frame to be displayed, generates a corresponding output frame 52 which is to be used to drive a display 53 to display the corresponding input frame. The output frame 52 is read by a display controller 54 and provided to the display 53 for display.

In accordance with overdrive techniques, the output frame 52 that is generated by the overdrive engine 50 from an input frame to be displayed may be an "overdriven" version of the input frame, i.e. including some form of overdrive factor and therefore may not correspond exactly to the input frame. The display 53 will be, for example, an LCD or OLED display.

In the arrangement shown in FIG. 5, it is assumed that the overdrive calculation and process uses the current frame 55 (i.e. the new input frame to be displayed) and the immediately preceding input frame 56. However, other arrangements in which plural input frames are used for the overdrive process would be possible, and the present embodiments apply equally to and can be used correspondingly for such overdrive arrangements as well.

Also, it is assumed in the FIG. 5 arrangement that the input frames come from a single source, i.e. are generated as a single surface that is then provided to the overdrive engine 50. It would also, as is known in the art, be possible for the input frames to be composited frames that are composited from plural different source surfaces (frames) (and indeed that may be relatively common). Again, the present embodiments extend to such arrangements in which the input frames 51 are in fact composited frames formed from plural source surfaces (frames).

As shown in FIG. 5, the present embodiments differ from the conventional overdrive operation in that, firstly, the input and output frames are processed as a succession of smaller regions (parts) 57, 58 of those frames. Thus the output frame is generated on a region-by-region basis with each respective region of the output frame being generated from the corresponding region of the input frame. (It is assumed for simplicity in the present embodiments that there is a one-to-one mapping between the regions 57 of the input frames 51 and the regions 58 of the output frame 52. However, other arrangements, in which, for example, there is not a one-to-one mapping between the input frame regions and the output frame regions would be possible, if desired.)

Also, and as will be discussed in more detail below, in the present embodiments when the overdrive engine 50 is processing an input frame to generate an output frame 52 for provision to the display 53, the overdrive engine first determines whether the relevant input frame region has changed or at least significantly changed since the previous input frame or not. If the relevant input frame region is determined to have changed since the previous version of the input frame, then the overdrive engine generates an overdriven version of the input frame region, using the region for the current input frame and the corresponding region for the previous input frame, in an overdrive process, to thereby provide an overdriven region in the output frame 52.

However, if it is determined that the input frame region has not changed, then the overdrive engine 50 does not perform any form of overdrive calculation for that region, but instead simply provides the region from the current input frame (from the new input frame to be displayed) as the corresponding region in the output frame. This then avoids the need to read the previous input frame and perform any overdrive calculation in the situation where it is determined that an input frame region has not changed.

The effect of this then is that the output frame 52 may contain both regions that are overdriven (that are overdriven versions of the corresponding input frame regions) and regions that are not overdriven (that simply correspond to the current input frame region as it currently stands).

The overdrive engine 50 performs this operation for each input frame region in turn when a new input frame is to be displayed, to correspondingly generate a new output frame 52 which can then be read by the display controller 54 and used to drive the display 53.

In the present embodiments the regions 57, 58 of the input 51 and output 52 frames that are considered correspond to the respective rendering tiles that a graphics processor that is rendering the respective input frames generates. Other arrangements and configurations of frame regions could be used if desired.

Figure 3:
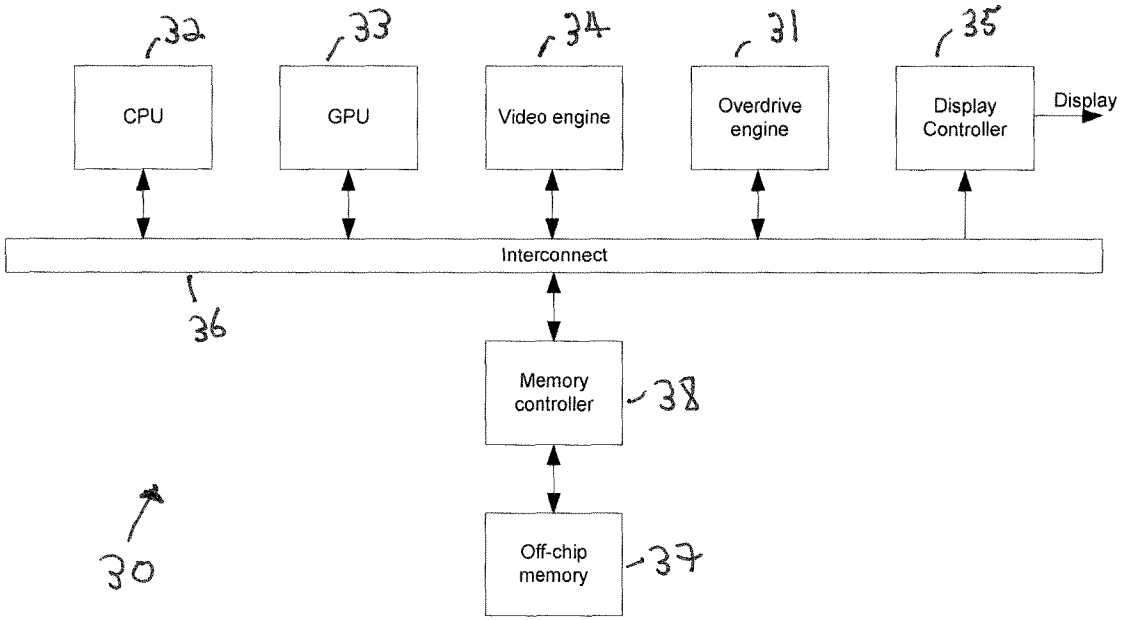
Fig. 3 Prior Art
FIG. 3 shows schematically an exemplary data processing system that can perform overdrive operations.

The embodiments of the technology described herein can be implemented in any desired form of data processing system that provides frames for display. Thus they could, for example, be used in a system such as that shown in FIG. 3 described above. In this case the overdrive engine 31 would be configured to operate in the manner of the present embodiments.

Figure 6:
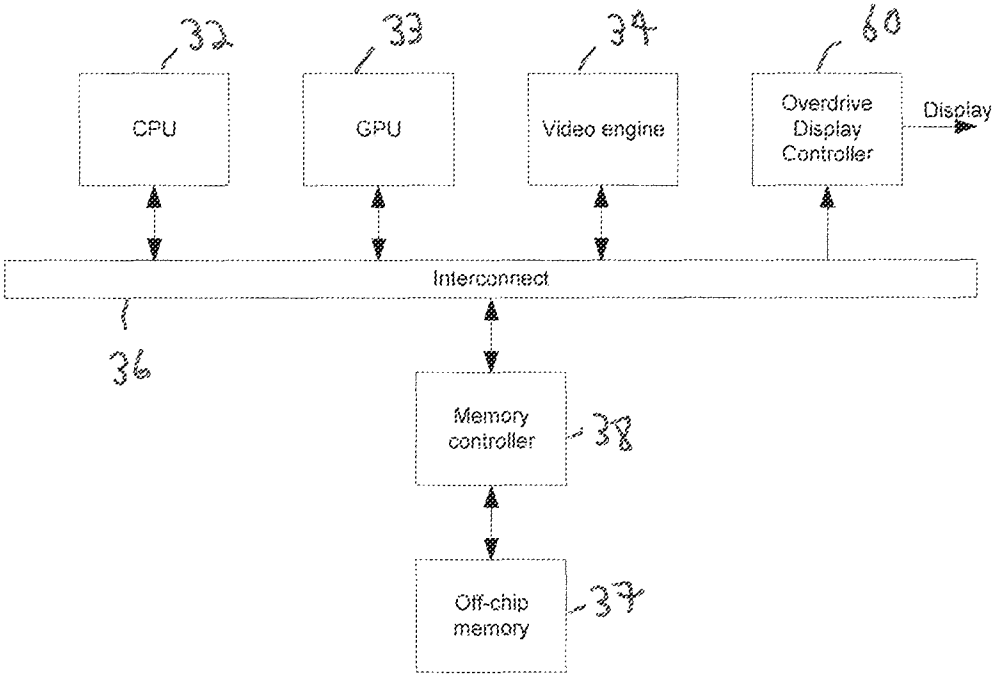
FIGS. 6, 7, and 8 show schematically exemplary data processing systems that can operate in accordance with the described embodiments of the technology described herein.
Figure 7:
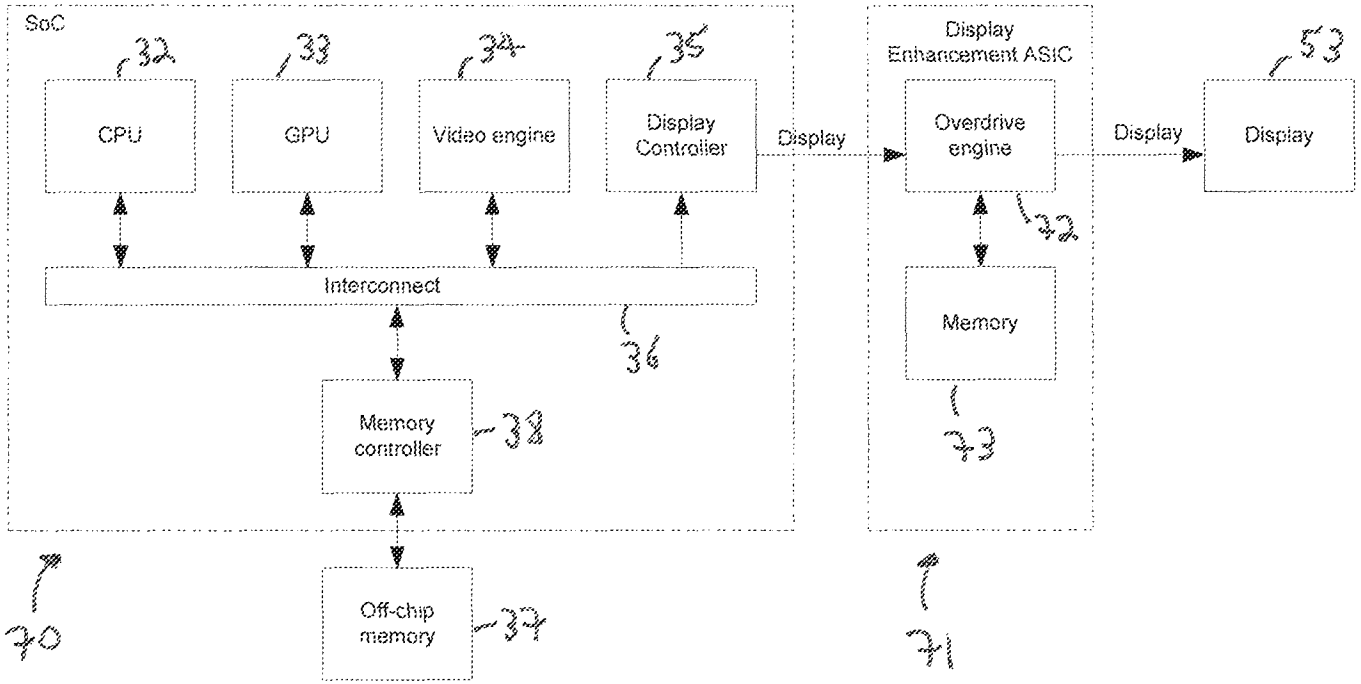
Figure 8:
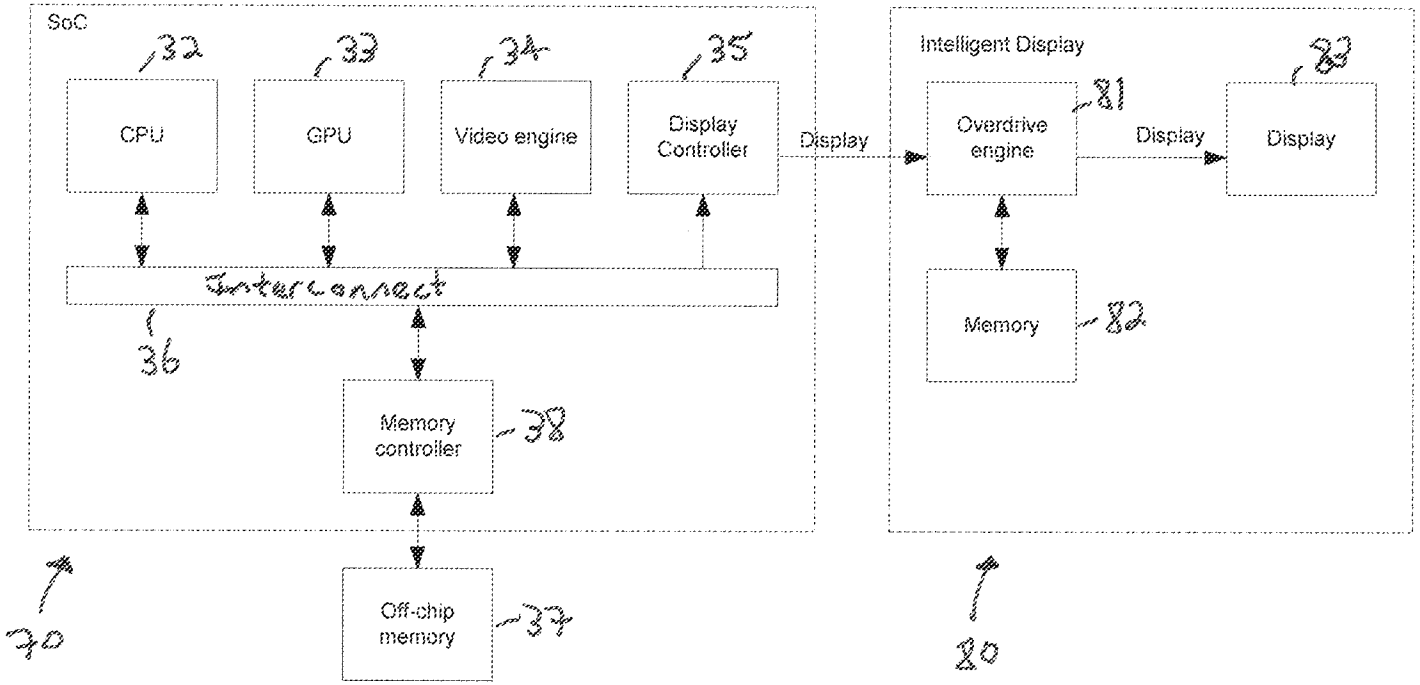

FIGS. 6, 7 and 8 show further exemplary systems in which the present embodiments may be implemented.

FIG. 6 shows an arrangement in which the display controller 60 incorporates and executes the overdrive engine itself. This arrangement can avoid the need to write the overdrive frame to memory, thereby saving bandwidth.

FIG. 7 shows an arrangement in which there is a system on-chip (SoC) 70 which includes the CPU 32, GPU 33, video engine 34, display controller 35, memory controller 38 and interconnect 36, and a separate "display enhancement" ASIC 71 that includes the overdrive engine 72 and appropriate memory 73. Output frames are then provided from the display enhancement ASIC 71 to the display 53.

FIG. 8 shows a further arrangement in which again there is a system on-chip 70 including a CPU 32, a GPU 33, a video engine 34, a display controller 35, an interconnect 36 and a memory controller 38, having access to off-chip memory 37, that generates and provides input frames to an "intelligent" display 80. The "intelligent" display 80 then includes the overdrive engine 81, appropriate memory 82, and the display 83. It is assumed in this case that the "intelligent" display 80 has its own processing ability and memory such that it is able to execute the overdrive engine and process itself.

As discussed above, the present embodiments operate to generate an output frame for provision to the display from an input frame on a region-by-region basis. For each input frame region that is being processed, it is determined whether the input frame region has (significantly) changed since the previous version of the input frame, and if it is determined that the input region has changed, an overdriven version of the input frame region is generated for use as the corresponding region in the output frame. On the other hand, if it is determined that the input frame region has not changed since the previous version of the input frame, then the new input frame region is used as it is (i.e. without performing any form of overdrive process on it) for the corresponding region in the output frame.

In the present embodiments, the determination of whether an input frame region has changed or not is done by considering signatures representative of the content of the input frame region and of the previous version of the input frame region. This process will be discussed in more detail below.

To facilitate this operation, content-indicating signatures are generated for each input frame region, and those content-indicating signatures, as well as the data representing the frame regions themselves, are stored and then used. This data may all be stored, for example, in the off-chip memory 37. Other arrangements would, of course, be possible, if desired.

FIG. 9 illustrates this data and how it may be stored in memory in an embodiment of the technology described herein.

As shown in FIG. 9, and as discussed above, each input frame 51 has associated with it a set of signatures 90, 91 that represent the content of the respective frame regions 57. Data 92*a*, 92*b* representing each respective region 57 of the input frames 51 is stored in memory 37, together with sets of signatures 94*a* and 94*b* that represent the content of the regions of the respective input frames.

Figure 10:
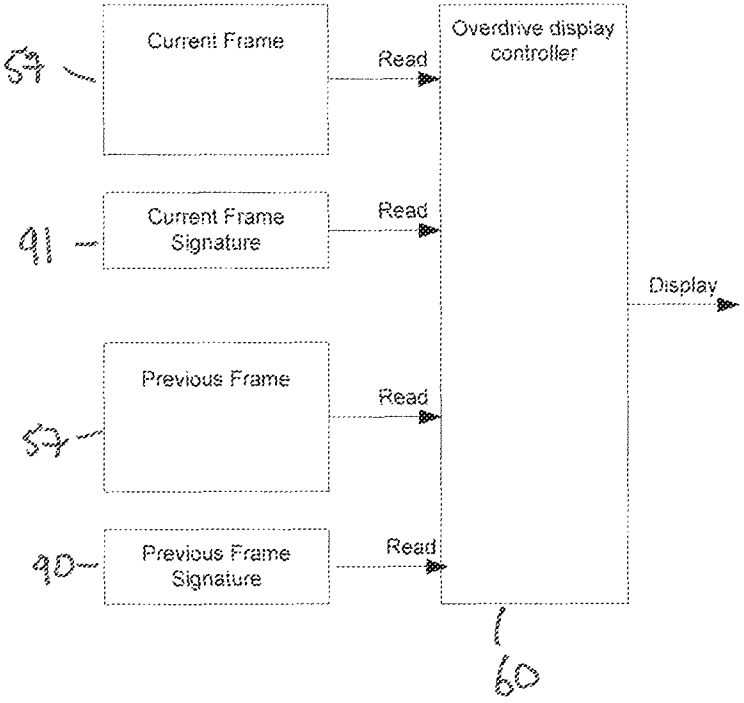
FIG. 10 shows schematically the overdrive operation in embodiments of the technology described herein.

FIG. 10 then shows schematically the use of this signature data 90, 91 by the overdrive engine, in this case in the example where the overdrive engine is incorporated in an overdrive display controller 60 (i.e. a display controller that is itself capable of and operates to perform the overdrive process).

Figure 11:
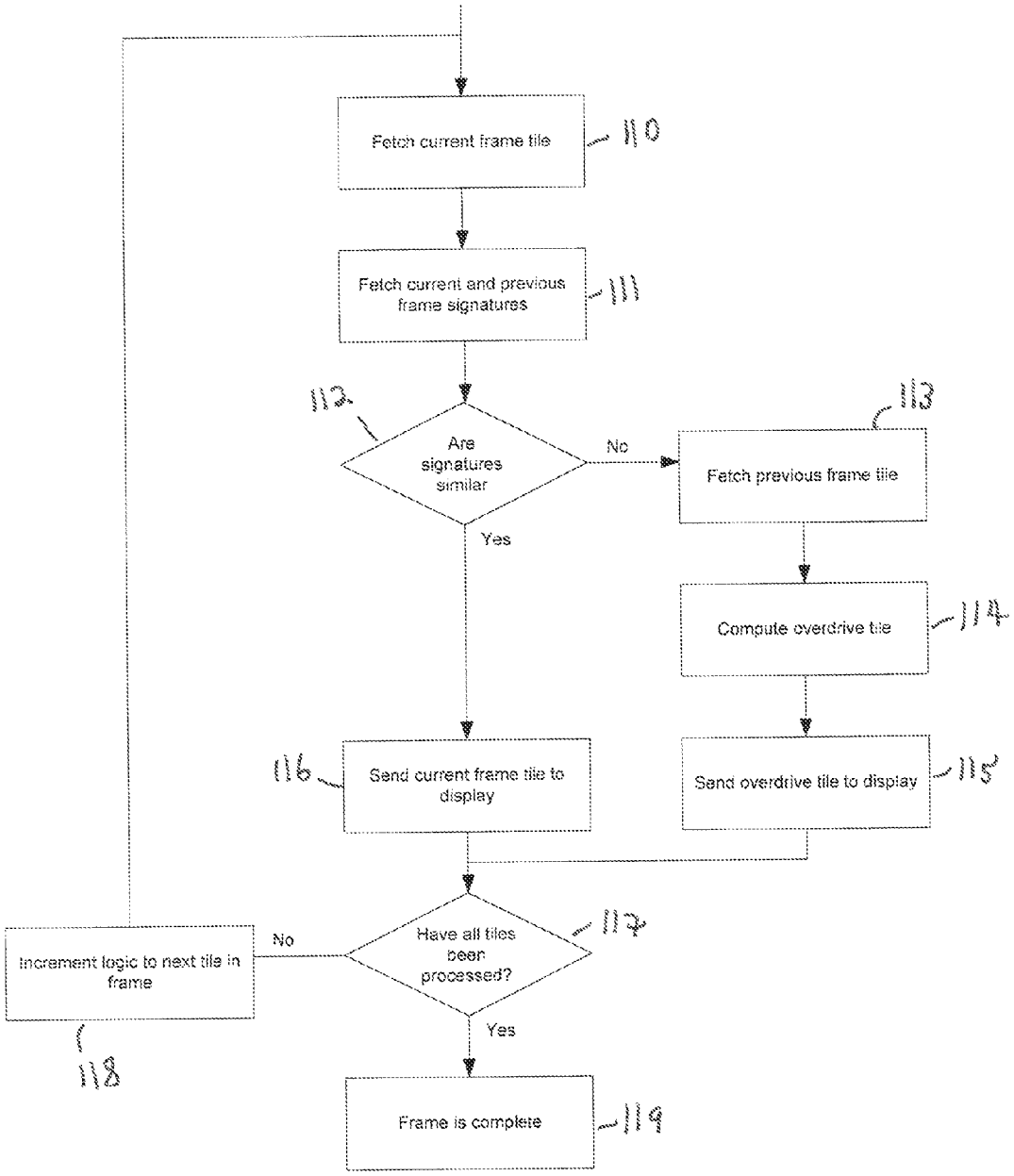
FIG. 11 is a flowchart illustrating the overdrive operation in embodiments of the technology described herein.
Figure 12:
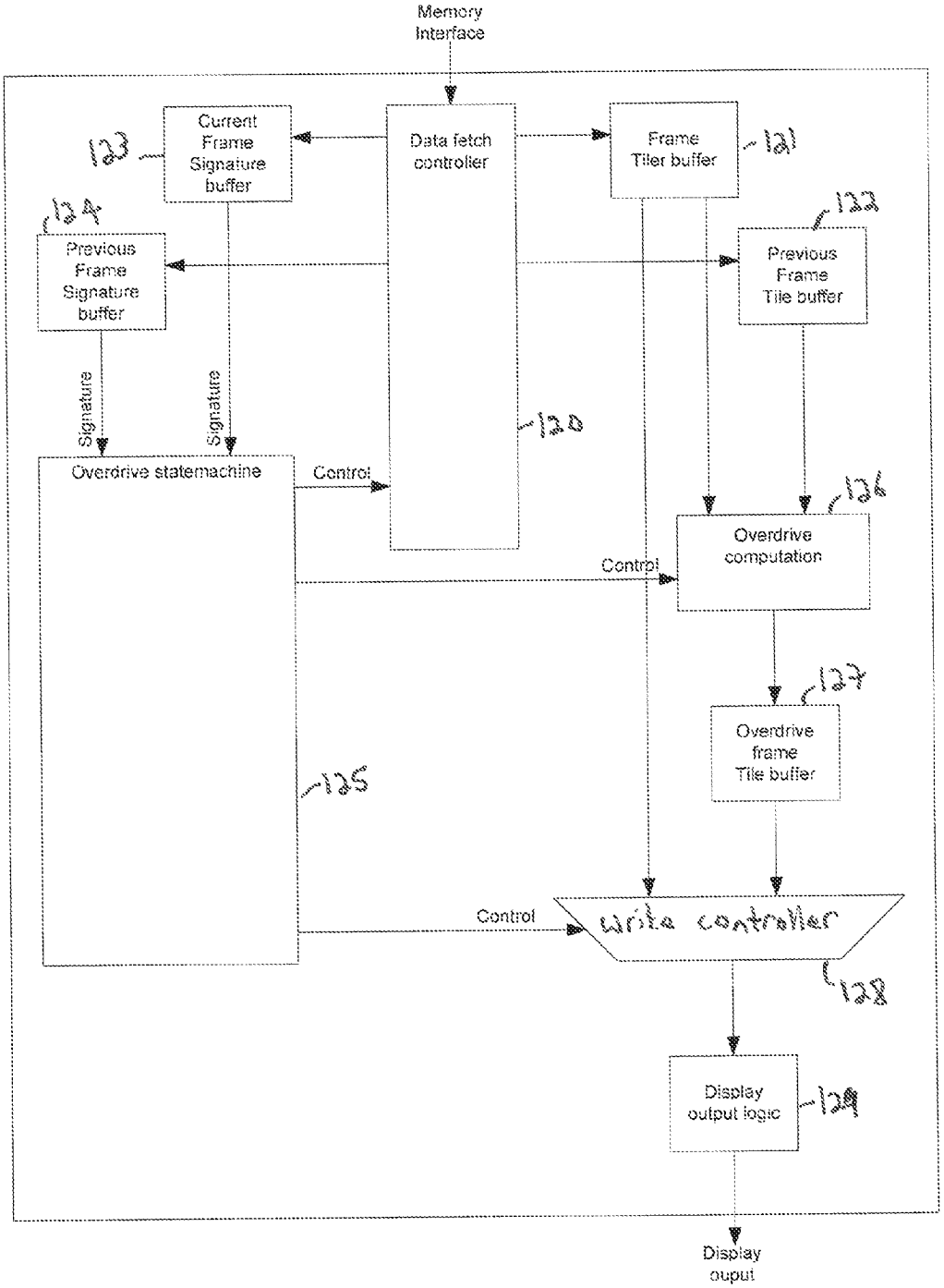
FIG. 12 shows schematically the overdrive operation in embodiments of the technology described herein.

FIGS. 11 and 12 show in more detail embodiments of the operation of the overdrive process for overdrive display processors when generating output frames for display in the present embodiments. It is assumed here that a new output frame to be displayed is required, e.g. to refresh the display, and so a new output frame will be generated from an input frame for providing to the display.

As shown in FIG. 11, the process starts with the overdrive engine fetching the next tile (region) of the input frame to be considered (step 110). Then, the tile signatures for the tile (region) in question for the current input frame (i.e. the new input frame to be displayed) and for the previous version of the input frame (that was used to generate the output frame that is currently being displayed) are fetched and compared (steps 111 and 112).

If it is determined that the tile signatures are not the same (i.e. it is accordingly determined that the input frame tile (region) has (significantly) changed since the previous frame), then as shown in FIG. 11, an overdrive process is performed. Thus the overdrive engine fetches the corresponding tile from the previous input frame (step 113) and derives an overdriven tile using the tile from the current input frame and the tile from the previous input frame (step 114) and then provides the so-generated overdriven tile as the tile for that tile position in the output frame that is then sent to the display (step 115).

On the other hand, if at step 112 it is determined that the tile signatures for the tile (region) for the current and previous input frames are the same (i.e. such that it is determined that the tile has not changed in the current input frame), then the overdrive process is not performed and instead the tile from the current input frame (i.e. from the new input frame to be displayed) is provided as the corresponding tile in the output frame that is sent to the display (step 116).

This process is repeated for all the tiles in the input frame (for each output frame region that is required), until the output frame is complete (steps 117, 118 and 119). The input frame tiles (regions) may be processed in turn or in parallel, as desired (and, e.g., depending on the processing capabilities of the device that is implementing the overdrive engine).

FIG. 12 is a block diagram showing the data and control flows, etc. in a display controller that can operate in the manner of the present embodiments.

As shown in FIG. 12, the display controller will include a data fetch controller 120 that is operable to fetch from memory the tiles from the current and previous input frames, and their corresponding content-indicating signatures and store that data in a frame tile buffer 121, a previous frame file buffer 122, a current frame signature buffer 123, and a previous frame signature buffer 124, respectively.

An overdrive state machine 125 then operates to compare the signatures of the tiles from the current and previous frames from the current frame signature buffer 123 and the previous frame signature buffer 124 and to, if required, trigger an overdrive computation 126 and the storing of an overdrive frame tile in an overdrive frame tile buffer 127. The overdrive state machine 125 also controls a write controller 128 to either provide the current input frame tile from the input frame tile buffer 121 or the generated overdriven frame tile from the overdrive frame tile buffer 127 to the display output logic 129, as appropriate.

Although the above embodiments have been described with particular reference to the processing of a given output frame, as will be appreciated, the operation of the present embodiments will correspondingly be repeated whenever a new version of an input frame is to be displayed, as new versions of the output frame are generated.

Figure 13:
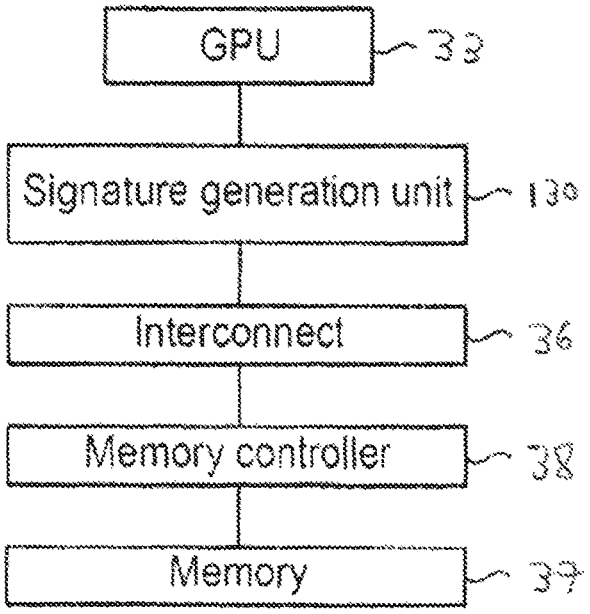
FIGS. 13 and 14 show schematically the signature generation process that is used in embodiments of the technology described herein.
Figure 14:
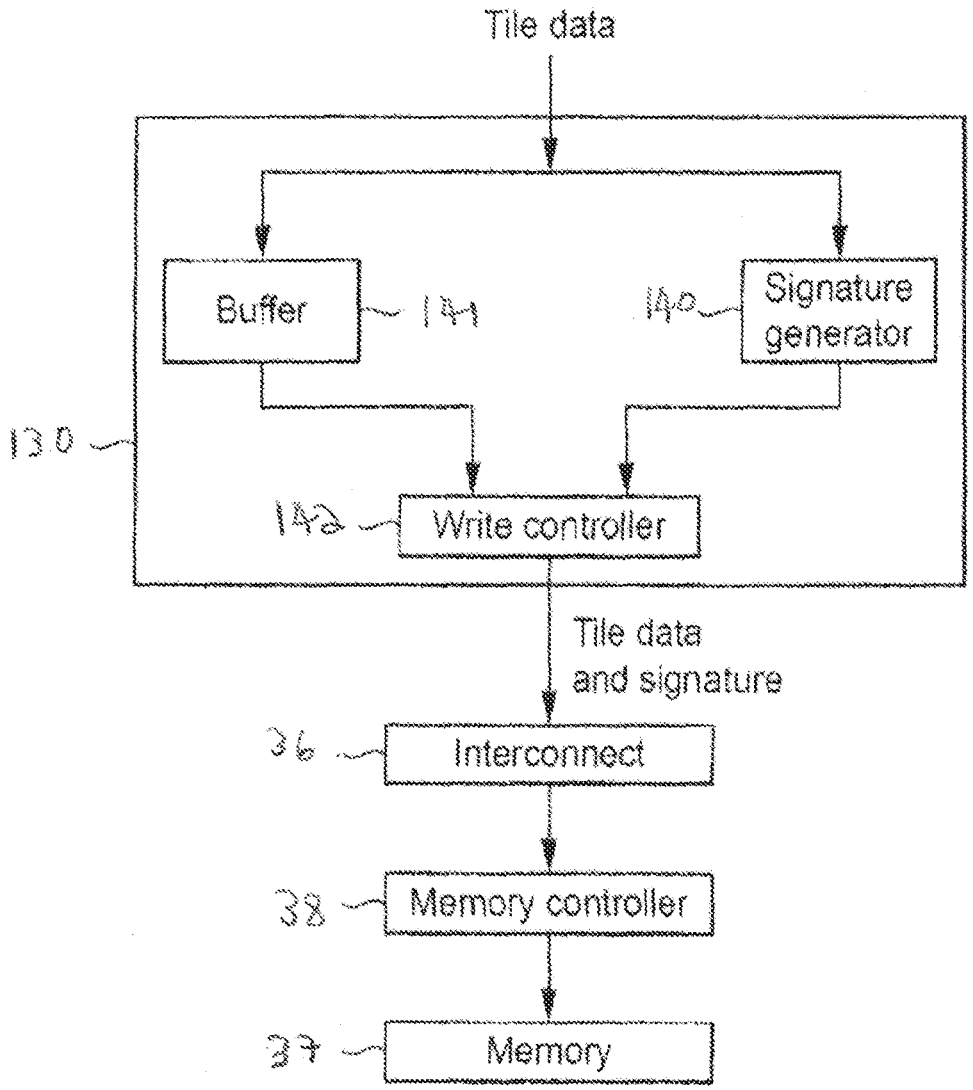

As discussed above, the present embodiments use signatures representative of the content of the respective input frame regions (tiles) to determine whether those tiles (regions) have changed or not. FIGS. 13 and 14 show schematically an exemplary arrangement for generating the input frame tile content-indicating signatures. Other arrangements would, of course, be possible.

In the present embodiments, this process uses a signature generation hardware unit 130. The signature generation unit 130 operates to generate for each input frame tile a signature representative of the content of the tile.

As shown in FIG. 14, tile data is received by the signature generation unit 130, e.g. from the graphics or other processor that is generating the input frames, and is passed both to a buffer 141 which temporarily stores the tile data while the signature generation process takes place, and a signature generator 140.

The signature generator 140 operates to generate the necessary signature for the tile. In the present embodiment the signature is in the form of a 32-bit CRC for the tile. Other signature generation functions and other forms of signature such as hash functions, etc., could also or instead be used, if desired.

Once the signature for a new tile has been generated, a write controller 142 of the signature generation hardware unit 130 operates to store the signature in a per-tile signature buffer that is associated with the version of the input frame in question in the memory 37, under the control of a write controller 142. The corresponding tile data is also stored in the appropriate buffer in the memory 37.

In the present embodiments, the content-indicating signatures for the tiles are generated using only a selected set of the most significant bits of the colours (MSB) in each tile (e.g. for RGB 8-bit per pixel—R[7:2], G[7:2], B[7:2]). These MSB signatures are then used, as discussed above, to determine whether there has been a more significant change between the tiles (and to accordingly trigger the overdrive operation or not). The effect of basing the content-indicating signatures that are used to determine whether there has been a change between the input frame tiles (regions) on the MSB of the tile data (colour) values only is that minor changes between the tiles (e.g. changes in the least significant bits (LSB) only) will not trigger the generation of an overdriven tile for the output frame, such that an overdriven version of the tile will only be generated for the output frame if there is a more significant change between the input frame tiles. This has the advantage of avoiding "overdriving" minor changes between tiles, thereby reducing or avoiding the overdrive process potentially simply acting to emphasise noise.

Other arrangements, such as using other colour spaces and/or dynamic ranges would, of course, be possible.

Other arrangements for effectively disabling the overdrive process (for not carrying out the overdrive process) for small changes between tiles could be used, if desired. For example, the comparison process could allow matches that are equal to or less than a predetermined threshold to still be considered to indicate that the input frame tile has not changed, even if there has been some change within the tile. It would also be possible simply to compare the entire region (tile).

It may also be the case that it is desirable for other purposes to also have a "full" content-indicating signature for the input frame tiles. In this case, two sets of signatures could, for example, be generated, one "full" signature, and another "reduced" signature for the overdrive process. Alternatively, the portions of the colours could be split to generate respective separate signatures, such as a first signature for MSB colour (e.g. R[7:4], G[7:4], B[7:4]), a second "mid-colour" signature (e.g. R[3:2], G[3:2], B[3:2]) and a third LSB colour signature (R[1:0], G[1:0], B[1:0]), for example, with the respective "part" signatures, e.g. the MSB colour signature, being used for the overdrive process, but then the respective "part" signatures being concatenated to provide a "full" content-indicating signature for the tile where that is required. Other arrangements would, of course, be possible.

Various alternatives, modifications and additions to the above-described embodiments of the technology described herein would be possible, if desired.

For example, the type of content being processed could be analysed to determine the overdrive process and/or overdrive value(s) to use. For example, the frames may be analysed or the colour space being used could be used to determine the type of content being processed (e.g. whether it is a video source or not), and that information could then be signalled and used to control, e.g., the signature comparison process and/or the form of signature that is being used for the comparison process (such as the number of MSB bits used in the signatures that are being compared), accordingly.

Similarly, it could be determined whether the input frame and/or an input frame region is changing rapidly (e.g. contains image edges), and the overdrive process, such as the signature comparison, controlled accordingly. In this case, this may be achieved by detecting whether an input frame region contains an image edge or not (such image edge detection may be performed, e.g., by the device generating the data (e.g. the GPU or video engine)), with edge detection co-efficient metadata then being generated for each input frame region. Alternatively, edge detection could be performed by the display controller.

The edge detection data (e.g. edge detection coefficient) could then be used, e.g., to determine the number of MSB that should be compared to determine if overdrive should be performed.

Also, although it has been assumed in the above embodiments that there is a one-to-one mapping between input frame regions and the output frame regions, that need not be the case. For example, there may be plural input frame regions that contribute, at least in part, to a given output frame region. This may be the case where, for example, the display controller fetches data in scan line order, but the input frame region signature data is for respective 2D tiles. In this case, a number of signature comparisons may need to be performed per scan line or part of a scan line. Also, in arrangements where the input frames are compressed, it may again be necessary to process the input frames in 2D blocks, even if the display itself operates on scan lines.

The above embodiments also describe the situation where the input frame that is to be displayed is formed from a single input surface only. However, it can also be the case that multiple source frames (source surfaces) can be composited to generate an input frame to be displayed (for example in a windows compositing system). In this case, respective content indicating signatures could, e.g., be generated for the final, composited input frame regions, which composited input frame region signatures are then compared to determine if the input frame from which the output frame is to be generated has changed or not. Alternatively, content-indicating signatures could be generated and compared for respective source frame regions, and then any changes in the source frame regions that contribute to an input frame region used to determine if the input frame region itself has changed.

Where it is necessary to determine which input frame regions (or which source frame regions in the case of composited input frames) contribute to the output frame region (or input frame region) in question, then that can be done as desired. For example, this could be based, e.g., on the process (e.g. algorithm) that is being used to generate the output frame region from the input frame regions, or that is being used to generate the input frame from the source surfaces in a window compositing process. Alternatively, a record (e.g. metadata) could be maintained of the input frame regions that contribute to each respective output frame region, and/or of each source frame region that contributes to each respective input frame region.

Also, in an embodiment only output frame regions that have been overdriven are stored in memory, with output frame regions that have not been overdriven being fetched instead directly from the new input frame. This will then avoid or reduce storing again output frame regions that are not being overdriven. In this case, metadata, e.g., could be used to indicate if an output frame region has been overdriven or not (to thereby trigger the fetching of the corresponding input frame region from the new input frame in the case where the output frame region has not been overdriven).

Although the above embodiments operate by determining whether it is necessary to generate an overdriven region for an output frame to be provided to a display, the Applicants have further recognised that in alternative embodiments it may still be advantageous to use a display controller that has the capability to generate the overdrive frame itself, irrespective of whether operation in the manner of the above embodiments is performed as well. In this case, the display controller will read both the new input frame and the previous input frame(s), and perform the overdrive calculation and then provide the overdriven frame directly to the display without the need to (and without) writing the overdrive frame to memory.

Figure 15:
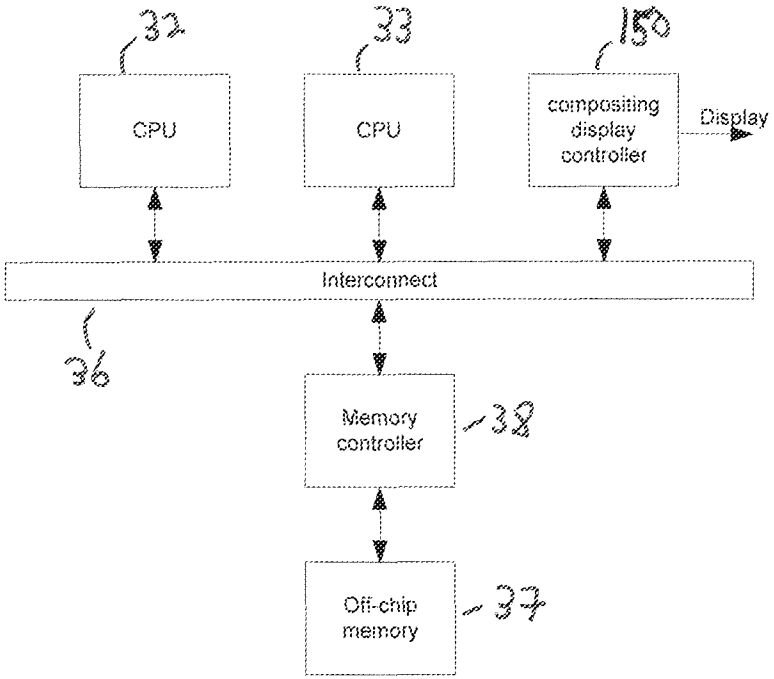
FIGS. 15 and 16 show schematically an alternative embodiment in which an overdrive operation is performed in a display controller.
Figure 16:
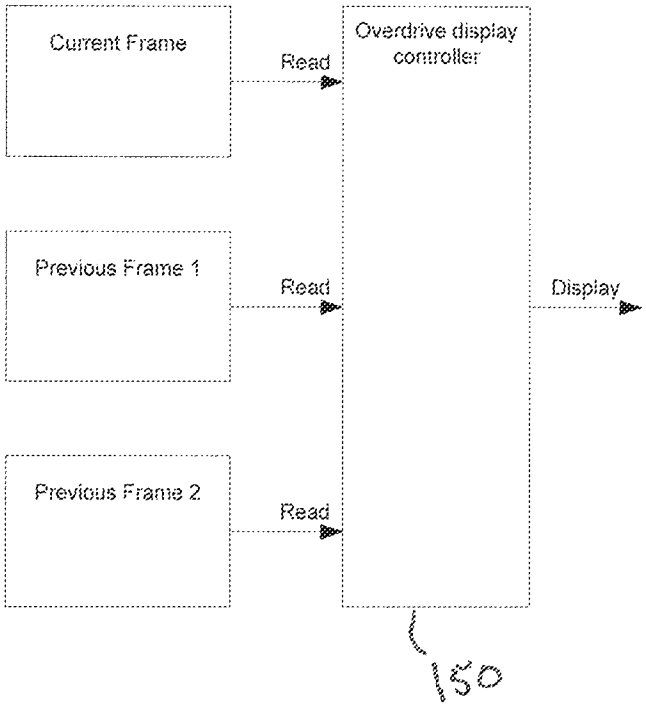

FIGS. 15 and 16 illustrate such an arrangement. As shown in FIG. 15, there is a compositing display controller 150 that can operate to read the current input frame and the previous input frame from the off-chip memory 37, perform the overdrive calculation and generate an overdrive frame that it can provide directly to the display without the need to store the overdrive frame in the off-chip memory 37. FIG. 16 correspondingly shows the display controller 150 reading the current and previous input frames and providing the resultant overdrive frame directly to the display.

As will be appreciated from the above, the technology described herein, in some embodiments at least, can provide a mechanism for performing overdrive on a display that can reduce the amount of data that must be fetched and the processing needed to perform the overdrive operation compared to known, conventional overdrive techniques. This can thereby reduce bandwidth and power requirements for performing overdrive.

This is achieved in the embodiments of the technology described herein at least, by determining whether respective regions of an input frame have changed between frames, and only performing the overdrive process for those input frame regions that it is determined have changed.

It would be apparent to those skilled in the art that numerous modifications and alterations of the method and apparatus described above may be made without departing from the teachings of the technology described herein. Accordingly, the above disclosure should be construed as limited only by the scope of the appended claims.

The invention claimed is:

1. A method of generating an output frame for provision to an electronic display for display from an input frame to be displayed when overdriving the electronic display, the method comprising:

generating on a region-by-region basis the output frame to be provided to the electronic display as a plurality of respective regions that together form the output frame, each respective region of the output frame being generated from a respective region or regions of the input frame to be displayed; and for two or more regions of the plurality of regions that together form the output frame, and on a region-by-region basis:

determining which region or regions of the input frame to be displayed are contributing region or regions that contribute to the region of the output frame;

determining whether the contributing region or regions of the input frame to be displayed have changed since the version of the output frame region that is currently being displayed on the display was generated; and when it is determined that the contributing region or regions of the input frame to be displayed have changed since the version of the output frame region that is currently being displayed on the display was generated, generating an overdriven region for the region of the output frame for provision to the electronic display based on the contributing region or regions of the input frame to be displayed and the contributing region or regions of at least one previous input frame.

2. The method of claim 1, comprising:

when it is determined that the contributing region or regions of the input frame to be displayed have not changed since the version of the output frame region that is currently being displayed on the display was generated, not generating an overdriven region for the region of the output frame for provision to the display and using the contributing region or regions of the input frame to be displayed for the region of the output frame for provision to the display.

3. The method of claim 1, wherein the input frame to be displayed is formed by compositing a plurality of different source frames.

4. The method of claim 1, wherein each frame region corresponds to a tile that a processor that is generating the frame produces as its output.

5. The method of claim 1, wherein the step of determining whether the contributing region or regions of the input frame to be displayed have changed since the version of the output frame region that is currently being displayed on the display was generated comprises comparing the respective versions of the input frame region or regions, or comparing respective versions of source frame regions that are used to generate the respective input frame region or regions, to determine if the input frame region or regions have changed.

6. The method of claim 1, wherein the step of determining whether the contributing region or regions of the input frame to be displayed have changed since the version of the output frame region that is currently being displayed on the display was generated, only determines that a frame region has changed when a new version of the region differs from a previous version of the region by at least a particular amount.

7. The method of claim 1, wherein the step of determining whether the contributing region or regions of the input frame to be displayed have changed since the version of the output frame region that is currently being displayed on the display was generated, only uses selected data for a frame region to determine if the frame region has changed.

8. The method of claim 1, wherein the step of determining whether the contributing region or regions of the input frame to be displayed have changed since the version of the output frame region that is currently being displayed on the display was generated comprises comparing signatures representative of the content of respective versions of the input frame region or regions, or comparing signatures representative of the content of respective versions of source frame regions that are used to generate the respective input frame region or regions, to determine if the input frame region or regions have changed.

9. The method of claim 8, wherein the signatures that are compared are based on a selected set of the most significant bits of the data for the frame regions.

10. The method of claim 8, comprising generating plural signatures, each signature representative of particular sets of bits of the frame region data for each frame region.

11. The method of claim 1, further comprising:

controlling a requirement for determining that a frame region has changed based on one or more of: the type of content that is to be displayed; whether the frame region in question is determined to be expected to be changing rapidly or not; and whether the frame region in question is determined to contain an image edge or not.

12. The method of claim 1, wherein the output frame to be provided to the electronic display is generated as a plurality of respective regions that together form the output frame, each respective region of the output frame being generated from a respective region or regions of the input frame to be displayed.

13. An apparatus for generating an output frame for provision to an electronic display for display from an input frame to be displayed when overdriving an electronic display, the apparatus comprising processing circuitry configured to:

generate on a region-by-region basis an output frame to be provided to an electronic display for display as a plurality of respective regions that together form the output frame, each respective region of the output frame being generated from a respective region or regions of the input frame to be displayed; and:

for two or more regions of the plurality of regions that together form the output frame, and on a region-by-region basis:

determine which region or regions of the input frame to be displayed are contributing region or regions that contribute to the region of the output frame;

determine whether the contributing region or regions of the input frame to be displayed have changed since the version of the output frame region that is currently being displayed on the display was generated; and when it is determined that the contributing region or regions of the input frame to be displayed have changed since the version of the output frame region that is currently being displayed on the display was generated, generate an overdriven region for the region of the output frame for provision to the electronic display based on the contributing region or regions of the input frame to be displayed and the contributing region or regions of at least one previous input frame.

14. The apparatus of claim 13, wherein the processing circuitry is configured to:

when it is determined that the contributing region or regions of the input frame to be displayed have not changed since the version of the output frame region that is currently being displayed on the display was generated, not generate an overdriven region for the region of the output frame for provision to the display and use the contributing region or regions of the input frame to be displayed for the region of the output frame for provision to the display.

15. The apparatus of claim 13, wherein the input frame to be displayed is formed by compositing a plurality of different source frames.

16. The apparatus of claim 13, wherein each frame region corresponds to a tile that a processor that is generating the frame produces as its output.

17. The apparatus of claim 13, wherein the processing circuitry is configured to determine whether the contributing region or regions of the input frame to be displayed have changed since the version of the output frame region that is currently being displayed on the display was generated by comparing the respective versions of the input frame region or regions, or comparing respective versions of source frame regions that are used to generate the respective input frame region or regions, to determine if the input frame region or regions have changed.

18. The apparatus of claim 13, wherein the processing circuitry is configured to only determine that a frame region has changed when a new version of the region differs from a previous version of the region by at least a particular amount.

19. The apparatus of claim 13, wherein the processing circuitry is configured to use only selected data for a frame region to determine if the frame region has changed.

20. The apparatus of claim 13, wherein the processing circuitry is configured to determine whether the contributing region or regions of the input frame to be displayed have changed since the version of the output frame region that is currently being displayed on the display was generated by comparing signatures representative of the content of respective versions of the input frame region or regions, or comparing signatures representative of the content of respective versions of source frame regions that are used to generate the respective input frame region or regions, to determine if the input frame region or regions have changed.

21. The apparatus of claim 20, wherein the signatures that are compared are based on a selected set of the most significant bits of the data for the frame regions.

22. The apparatus of claim 20, wherein the processing circuitry is configured to generate plural signatures, each signature representative of particular sets of bits of the frame region data for each frame region.

23. The apparatus of claim 13, wherein the processing circuitry is configured to:

control a requirement for determining that a frame region has changed based on one or more of: the type of content that is to be displayed; whether the frame region in question is determined to be expected to be changing rapidly or not; and whether the frame region in question is determined to contain an image edge or not.

24. The apparatus of claim 13, wherein the output frame to be provided to the electronic display is generated as a plurality of respective regions that together form the output frame, each respective region of the output frame being generated from a respective region or regions of the input frame to be displayed.

25. A display controller or a display comprising the apparatus of claim 13.

26. A computer program comprising computer software code stored in a non-transitory, computer-readable storage medium for performing a method of generating an output frame for provision to an electronic display for display from an input frame to be displayed when overdriving an electronic display when the program is run on a data processor, the method comprising:

generating on a region-by-region basis the output frame to be provided to the electronic display as a plurality of respective regions that together form the output frame, each respective region of the output frame being generated from a respective region or regions of the input frame to be displayed; and for two or more regions of the plurality of regions that together form the output frame, and on a region-by-region basis:

determining which region or regions of the input frame to be displayed are contributing region or regions that contribute to the region of the output frame;

determining whether the contributing region or regions of the input frame to be displayed have changed since the version of the output frame region that is currently being displayed on the display was generated; and when it is determined that the contributing region or regions of the input frame to be displayed have changed since the version of the output frame region that is currently being displayed on the display was generated, generating an overdriven region for the region of the output frame for provision to the electronic display based on the contributing region or regions of the input frame to be displayed and the contributing region or regions of at least one previous input frame.

* * * * *